US005248588A

United States Patent [19]

Nagaoka

[11] Patent Number: 5,248,588

[45] Date of Patent: Sep. 28, 1993

[54] SILVER HALIDE PHOTOGRAPHIC MATERIAL

[75] Inventor: Katsuro Nagaoka, Kanagawa, Japan

[73] Assignee: Fuji Photo Film Co., Ltd., Kanagawa, Japan

[21] Appl. No.: 704,245

[22] Filed: May 22, 1991

[30] Foreign Application Priority Data

May 23, 1990 [JP] Japan ..... 2-132948

[51] Int. Cl.[5] ..... G03C 1/09

[52] U.S. Cl. ..... 430/605; 430/608; 430/567; 430/569; 430/596

[58] Field of Search ..... 430/569, 605, 608, 596, 430/567

[56] References Cited

U.S. PATENT DOCUMENTS 3,206,313 9/1965 Porter et al. ..... 430/564
3,703,584 11/1972 Motter ..... 430/605
3,979,213 9/1976 Gilman, Jr. et al. ..... 430/604
4,092,171 5/1978 Bigelow ..... 430/604
4,623,612 11/1986 Nishikawa ..... 430/605
4,656,120 4/1987 Sugimoto et al. ..... 430/567

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

Disclosed is a silver halide photographic material, comprising a support having thereon (i) a silver halide emulsion layer which contains negative-working internal latent image-forming silver halide grains which have been chemically sensitized to a depth of less than 0.02 micrometer from the surface of the grain, and (ii) palladium in an amount from $1\times10^{-9}$ to $1\times10^{-2}$ mol per mol of coated silver halide.

9 Claims, No Drawings

SILVER HALIDE PHOTOGRAPHIC MATERIAL

FIELD OF THE INVENTION

The present invention relates to a silver halide photographic material and, more specifically, to a material which contains a negative-working internal latent image-forming emulsion (hereinafter abbreviate to "a negative internal latent image emulsion") and which has a high sensitivity and an improved storage stability.

BACKGROUND OF THE INVENTION

Various methods of elevating the sensitivity of photographic materials without enlarging the grain size of the silver halide grains in the emulsions which constitute the materials have heretofore been proposed. One example is a photographic material containing an internal latent image emulsion for forming a latent image on the inside of the grain by exposure, in which the inside of the grain is chemically sensitized. For instance, U.S. Pat. Nos. 2,696,436, 3,206,313, 3,917,485, 3,979,213 and 4,623,612 and JP-B-43-29405 and JP-B-45-13259 (the term "JP-B" as used herein means an "examined Japanese patent publication") describe techniques for producing silver halide photographic emulsions having a large internal sensitivity and silver halide photographic materials containing such emulsions, by dipping a silver halide emulsion-coated sample in an $AgNO_3$ solution or in a silver halide solvent, or by sensitizing a silver halide emulsion by chemical sensitization followed by Ostwald ripening during the step of forming it, or by adding an aqueous $AgNO_3$ solution and an aqueous soluble halide solution to a silver halide emulsion during the step of forming it. It is asserted in these references that the silver halide photographic materials containing the emulsions thus prepared have excellent photographic characteristics. However, most of the photographic materials produced by the proposed techniques may express an excellent photographic sensitivity only to particular internal developers but do not express a sufficient photographic sensitivity to ordinary developers which do not contain an unusually large amount of a silver halide solvent such as potassium iodide or sodium thiosulfate.

In order to overcome this drawback, U.S. Pat. No. 3,966,476 describes an emulsion capable of forming a latent image by exposure. The latent image may be opened to the surface of the silver halide grain in the emulsion so that it may be developed with a surface developer. However, the emulsion described therein is not a so-called internal latent image emulsion and therefore it does not sufficiently display the excellent photographic characteristics found in an internal latent image emulsion.

U.S. Pat. Nos. 4,839,268 and JP-A-63-264740 (the term "JP-A" as used herein means an "unexamined published Japanese patent application") describe a technique relating to an internal latent image emulsion which is capable of expressing a high sensitivity to a developer having a broad range and a photographic material containing an emulsion of that type. These references state that an emulsion which expresses a sufficient photographic sensitivity to an ordinary photographic developer should have a structure so that the position for forming a latent image by exposure is within a specific distance of the surface of the emulsion grain and so that a latent image of some degree is formed also on the surface of the grain. However, the present inventors have found that in the emulsions disclosed in these references, the part which is chemically sensitized is very near the surface of the grain so that the emulsions are fogged too often and the storage stability of the photographic materials between the time of their manufacture and their use is bad.

Additionally, various reports have disclosed compounds having the function of preventing elevation of fog during storage. For instance, the antifoggants described in *Research Disclosure* RD 17643, page 24 and *Research Disclosure* RD 18716, page 649, as well as palladium complex salts, are known. Palladium complex salts appropriate for this purpose include those described in U.S. Pat. Nos. 2,448,060, 2,472,627, 2,472,631, 2,566,245, 2,565,245, 2,598,079, 2,953,455, 4,092,171 and 4,102,312, and JP-A-60-80847. However, these studies disclose only surface latent image emulsions which can not express a sufficient sensitivity or internal latent image type emulsions which can not be developed by ordinary negative developers. Consequently, there is no effective technique for reducing fog of an emulsion containing chemically sensitized grains at a position near the surface of the grain.

SUMMARY OF THE INVENTION

Accordingly, an object of the present invention is to provide a silver halide photographic material which has a satisfactory sensitivity-to-graininess ratio and which has an excellent storage stability between the time of its manufacture and the time of its use.

This object has been attained by a silver halide photographic material which comprises a silver halide emulsion layer containing negative internal latent image type silver halide grains which are chemically sensitized to a depth of less than 0.02 micrometer from the surface of the grain. The material also comprises palladium in an amount of from $1\times10^{-9}$ to $1\times10^{-2}$ mol per mol of the coated silver halide.

DETAILED DESCRIPTION OF THE INVENTION

The palladium for the photographic material of the present invention may be in the form of a palladium metal salt or metal complex salt. Preferably, such a salt or complex salt is in solution form, dissolved either in water or in another appropriate solvent. Specific examples of palladium salts usable in the present invention are mentioned below, but this list is not limiting.

Pd-1: $PdCl_2$
Pd-2: $Na_2[PdCl_4]$
Pd-3: $H_2[PdCl_4]$
Pd-4: $Ca_2[PdCl_4]$
Pd-5: $K_2[PdCl_4]$
Pd-6: $H_2[PdBr_4]$
Pd-7: $K_2[PdBr_4]$
Pd-8: $Ba_2[PdBr_4]$
Pd-9: $[Pd(NH_3)_4]Cl_2$
Pd-10: $[Pd(NH_3)_4](ClO_4)_2$
Pd-11: $[Pd(NH_3)_4](NO_3)_2$
Pd-12: $Pd(NH_3)_4Cl_2$
Pd-13: $Pd(NH_3)_4(OH)_2$
Pd-14: $Na_2[PdCl_6]$
Pd-15: $H_2PdBr_6]$
Pd-16: $(NH_4)_2[PdCl_6]_2$
Pd-17: $(NH_4)_2[PdCl_4]$
Pd-18: $K_2[PdCl_6]$

Pd-19: $K_2[PdBr_6]$
Pd-20: $Pd(NH_3)_2Br_2$
Pd-21: $Pd(NH_3)_2I_2$
Pd-22: $Pd(NH_3)_2SO_4$
Pd-23: $Pd(NH_3)_2CO_3$
Pd-24: $Pd(NH_3)(NO_3)_2$
Pd-25: $K_2[Pd(CNS)_4]$
Pd-26: $K_2[Pd(NO_3)_4]$
Pd-27: $(NH_4)_2[Pd(NO_3)_4]$
Pd-28: $(NH_4)_2[PdBr_2(NO_3)_4]$

In the present invention, the amount of palladium to be used varies, depending upon the type of the silver halide photographic material. Specifically, the amount of palladium should be from $1\times10^{-9}$ mol to $1\times10^{-2}$ mol per mol of the coated silver halide in the material, preferably from $5\times10^{-7}$ mol to $1\times10^{-3}$ mol, more preferably from $1\times10^{-6}$ mol to $10^{-4}$ mol. The optimum amount of palladium is selected from within the defined range, depending on the grain size of silver halide grains, the crystal habit thereof and the sensitizing dyes and other additives combined with the silver halide grains. In general, if the amount of palladium in the photographic material of the present invention is less than $1\times10^{-9}$ mol, the effect sought caused by incorporation of palladium is insufficient. If it is more than $1\times10^{-2}$ mol, the excess palladium may have a bad influence on the photographic properties of the material, such as desensitization thereof.

Palladium must be incorporated into at least one layer of the photographic material of the present invention, preferably into at least one silver halide emulsion layer of the material. Most preferably, it is incorporated into the particular silver halide emulsion containing the negative internal latent image silver halide grains chemically sensitized to a depth less than 0.02 micrometer from the surface of the grain. The palladium may be added to the silver halide emulsion at any stage during formation of silver halide grain nuclei, growth of silver halide grains, and physical ripening and/or chemical ripening of silver halide grains. If desired, it may be added to the emulsion in portions over a period of time.

The internal latent image emulsion of the present invention contains silver halide grains which are chemically sensitized to a depth less than 0.02 micrometer from the surface of the grain. On the other hand, if the emulsion contains silver halide grains chemically sensitized to a depth of 0.02 micrometer or more from the surface of the grain, development of the emulsion would be insufficient even if it is developed with conventional developers for black-and-white photographic materials, color negative photographic materials or color reversal photographic materials. In that case, not only is the substantial sensitivity of the emulsion lowered, but also the other effects of the present invention caused by addition of palladium are lost.

The conventional developers referred to above are not those which contain no silver halide solvent for the purpose of developing only surface latent images or those which contain a large amount of a silver halide solvent for the purpose of developing internal latent images. Rather they are developers which contain a silver halide solvent in such an amount that they suitably dissolve silver halides in the emulsion to cause reduction thereof so as to express the optimum sensitivity of the emulsion. However, if the developer applied to the photographic material of the present invention contains too much solvent, dissolution of silver halides proceeds too far during processing to worsen the granularity by infectious development. Specifically, therefore, it is desired that the developer for processing the photographic material of the present invention contains, as a silver halide solvent, 100 g/liter or less and at least 20 g/liter of potassium iodide or 100 g/liter or less and at least 20 g/liter of sodium sulfite or potassium sulfite. Additionally, the developer may also contain potassium thiocyanate as a silver halide solvent.

The negative internal latent image type silver halide grains to be specifically employed in the present invention are chemically sensitized to a depth, preferably from 0.002 micrometer to less than 0.015 micrometer, more preferably from 0.004 micrometer to less than 0.01 micrometer, from the surface of the grain.

Special attention may be paid not only to the position to be chemically sensitized in the grain but also to the latent image distribution in the grain, including the ratio of surface sensitivity to internal sensitivity therein. It is most preferred that the latent image distribution in the grain to be formed by exposure has at least one maximum value (peak), at a point less than 0.01 micrometer from the surface of the grain and that the surface of the grain is also chemically sensitized to the degree from 1/5 time to less than 1/1 of maximum value thereof.

The latent image distribution referred to herein is measured by the relationship between the horizontal axis which is the depth (x micrometer) of the latent image from the surface of the grain and the vertical axis is the number (y) of latent images. x is represented by the following formula:

$$x = \frac{S}{2} \times \left(1 - \sqrt[3]{\frac{Ag_1}{Ag_0}}\right)$$

wherein

S is the mean grain size (micrometer) Of the silver halide emulsion grains;

$Ag_1$ is the amount of silver remaining in the emulsion-coated and non-exposed sample processed by the following processing; and $Ag_2$ is the amount of silver in the non-processed sample.

The term y is the reciprocal of the amount of exposure which gives a density of (fog+0.2) when the sample is exposed to a white light for 1/100 second and then processed by the following processing. The processing needed to obtain the latent image distribution mentioned above comprises subjecting the sample with a processing solution comprising:

| | |
|---|---|
| N-methyl-p-aminophenol Sulfate | 2.5 g |
| Sodium L-ascorbate | 10 g |
| Sodium Metaborate | 35 g |
| Potassium Bromide | 1 g |
| Water to make | 1 liter |
| | (pH 9.6) |

and containing sodium thiosulfate in an amount from 0 to 10 g/liter, at 25° C. for 5 minutes. By varying the amount of sodium thiosulfate from 0 to 10 g/liter in the processing solution, the depth of the latent image, which is to be developed by the processing, from the surface of the silver halide grain can be varied. From this variation, the variation of the number of the latent images in the direction of the depth can be determined.

Known methods for preparing the internal latent image type emulsion of the present invention, for example, those described in U.S. Pat. Nos. 3,979,213, 3,966,476, 3,206,313 and 3,917,485 and JP-B-43-29405 and 45-13259 may be used. For the purpose of obtaining the emulsion having the determined latent image distribution of the present invention, the chemical sensitization method, the amount of the silver halide to be precipitated after chemical sensitization, and the conditions for precipitation, must be properly adjusted.

For instance, U.S. Pat. No. 3,966,476 discloses a method of precipitating silver halide on chemically sensitized emulsion grains by a controlled double jet. However, when a silver halide is precipitated on the chemically sensitized grains by the method as disclosed in the U.S. Patent specification, it is impossible to embed the light-sensitive nucleus into the inside of the grain. Therefore, in order to obtain the particular latent image distribution of the present invention, it is necessary that the amount of the silver halide precipitated on the chemically sensitized grains is more than that taught in U.S. Pat. No. 3,966,476 and that the precipitation conditions (for example, the solubility of silver halides during precipitation and the speed of adding soluble silver salts and soluble halides) are properly controlled so that the thickness of the precipitate is less than 0.02 micrometer.

U.S. Pat. No. 3,979,213 discloses the preparation of an internal latent image type emulsion by a controlled double jet method of re-precipitating a silver halide on the emulsion grains as chemically sensitized on the surface thereof. Where a silver halide of the amount taught in the U.S. Patent specification is re-precipitated over the previously chemically sensitized grains, the proportion of the surface sensitivity of the resulting grain to the total sensitivity thereof is smaller than 1/10. Accordingly, in order to obtain the most preferred latent image distribution, the amount of the silver halide re-precipitated after chemical sensitization must be smaller than that taught in U.S. Pat. No. 3,979,213.

The most preferred method of producing the internal latent image type emulsion of the present invention is a modification of the method of forming a shell over a silver halide core grain described in Japanese Patent Application No. 1-1150728, in which formation of the shell is effected in the presence of a tetrazaindene compound after chemical sensitization of the core grain.

In that method, it is preferred that the tetrazaindene compound is in a dispersed system or emulsion containing a dispersion of seed grains and/or silver halide grains to grow from the nuclei of the seed grains, in an amount of from $1\times10^{-1}$ to $1\times10^{-5}$ mol, more preferably from $1\times10^{-2}$ to $1\times10^{-4}$ mol, per mol of silver halide in the emulsion.

The amount of the tetrazaindene compound is a great influence on the latent image distribution from the surface of the silver halide grain to the inside thereof. The optimum amount thereof properly varies within the above-mentioned range, depending upon the halogen composition of the emulsion grains as well as on the pAg and pH values and temperature during the step of precipitating an additional silver halide on the cores or the step of growing the cores.

For instance, when the amount of Ag for forming shells is large and the number of the latent images on the surface of the shell is small, it is desired that the amount of the tetrazaindene compound is at the high end of the defined range. However, when the amount of Ag for forming shells is small and the number of the latent images on the surface of the shell is large, it is desired that the amount of the compound is at the low end of the defined range.

The tetrazaindene compound may directly be added to a water-soluble protective colloid solution containing seed grains, or alternatively, it may be added to an aqueous water-soluble silver halide solution and the resulting solution is then added to the nuclei of the seed silver halide grains gradually along with the growth of the seed grains.

The tetrazaindene compound may be in the emulsion while the core grains in the emulsion grow further. Therefore, the compound may be added to the emulsion before the step of chemical sensitization of the emulsion. In particular, since tetrazaindene compounds have the function of adsorbing to silver halide grains to specify the position of the grain to be chemically sensitized, it is preferred that the compound is present in the emulsion also during the step of chemical sensitization of the cores therein.

In the present invention, the amount of silver used in forming a shell over the chemically sensitized core, that is the amount of silver (M) of the shell part may satisfy the following formula:

$$\left(1-\sqrt[3]{\frac{M_0}{M_0+M}}\right)\times R<0.02$$

wherein $M_0$ is the amount of silver of seed grain; and

R is the finally produced grain size (micron).

In the present invention, it is desired that the silver potential (SCE) in the step of forming the shell over the core grain is from −30 mV to +80 mV. If it is higher than +80 mV, the remaining chemical sensitizer often reacts with the shell part in the step of forming the shell over the core. As a result, the surface sensitivity of the resulting grain is often higher than the internal sensitivity thereof.

On the other hand, if the formation of the shell over the core grain is effected under conditions of less than −30 mV, the surface of the chemically sensitized core grain is oxidized with excess halogen, lowering the sensitivity of the resulting grain. Accordingly, the preferred silver potential in the core grain growing step is from −10 mV to +60 mV.

The temperature during the step of forming the shell over the core grain in the present invention is preferably from +35° C. to +70° C. If it is higher than +70° C., the remaining chemical sensitizing agent often reacts with the shell part, for the same reason as mentioned above, so that the surface sensitivity can not be lowered than the internal sensitivity. On the contrary, if growth of the core grain is effected at a temperature lower than +35° C., new nuclei form during the step of the growth of the grain. As a result, a sufficient amount of the additional silver halide does not precipitate on the chemical-sensitized site of the core grain. That is, such a low temperature is unfavorable because of the formation of undesired new nuclei during the shell-forming step. For these reasons, a more preferred temperature range during the shell-forming step is from 45° C. to 60° C.

In the present invention, it is preferred that the addition of a water-soluble silver salt solution to the emulsion during the step of growing the core grains therein is effected at a rate from 30 to 100 % of the critical speed of growing the silver halide crystals.

The crystal-growing critical speed referred to herein is defined as the uppermost limit to avoid substantial formation any new nuclei during the step of growing the silver halide grains. The wording "to avoid substantial formation of any new nuclei" as referred to herein means that the weight of the new crystal nuclei formed during the step, if any, is preferably 10% or less by weight of the total silver halide grains.

In the present invention, chemical sensitization of the above-mentioned core grains may be effected with an active gelatin, for example, by the method described in T. H. James' *The Theory of the Photographic Process,* 4th Ed. (published by MacMillan, 1977), pages 67 to 76. It may also be effected by the use of various sensitizing agents of sulfur, selenium, tellurium, gold, platinum or iridium compounds or the combination thereof, for example, in accordance with the methods described in *Research Disclosure,* Vol. 120, No. 12008 (April, 1974), in *Research Disclosure,* Vol. 34, No. (June, 1975) or in U.S. Pat. Nos. 2,642,361, 3,297,446, 3,772,031, 3,857,711, 3,901,714, 4,266,018 and 3,904,415 and British Patent 1,315,755.

In the most preferred embodiment, the chemical sensitization is effected in the presence of both a gold compound and a thiocyanate compound, or in the presence of a sulfur-containing compound described in U.S. Pat. Nos. 3,857,711, 4,266,018 and 4,054,457, or in the presence of other sulfur-containing compounds such as hypo, thiourea compound or rhodanine compound, under the conditions of a silver potential (SCE) of from ±0 mV to 120 mV, more preferably from +30 mV to +120 mV, especially preferably from +60 mV to +120 mV. In that step, the elevation of the silver potential in the reaction system or depression of the pAg value therein is favorable not only for obtaining a high sensitivity by effectively conducting the intended chemical sensitization reaction, but also for lowering the surface sensitivity below the internal sensitivity by reducing the excess chemical sensitizing agent which still remains during the successive formation of the shells over the chemically sensitized cores.

Chemical sensitization may be effected also in the presence of a chemical sensitization promoter. Such a chemical sensitization promoter can be those conventional compounds which are known to inhibit fog during the step of chemical sensitization and to elevate the sensitivity of the sensitized grains, for example, azapyridazines or azapyrimidines. Examples of the use of such chemical sensitization promoters for improving the properties of the sensitized grains are described in, for example, U.S. Pat. Nos. 2,131,038, 3,411,914 and 3,554,757, JP-A-58-126526, and G. F. Duffin, *Photographic Emulsion Chemistry* (published by Focal Press, 1966), pages 138 to 143.

In addition to the chemical sensitization or in place of it, reduction sensitization with, for example, hydrogen may be effected, as described in, for example, U.S. Pat. Nos. 3,891,446 and 3,984,249; reduction sensitization may also be effected with a reducing agent, such as stannous chloride, thiourea dioxide or polyamines, or at an elevated pH value (for example, at pH of more than 8), as described in U.S. Pat. Nos. 2,518,698, 2,743,182 and 2,743,183, if desired. Additionally, the chemical sensitization method as described in U.S. Pat. Nos. 3,917,485 and 3,966,476 may also be employed in the present invention for the purpose of elevating the color sensitivity of the sensitized grains.

Further, the sensitization method of using an oxidizing agent, as described in JP-A-61-3134 and JP-A-61-3136, may also be employed.

The emulsion of the present invention may be color-sensitized by any conventional methods known in this field. The amount of the sensitizing dye employed for color-sensitization in the present invention is such that one may obtain the highest minus blue sensitivity. It may also be approximately the same as the amount for obtaining the highest minus blue sensitivity in a surface latent image type emulsion. Addition of dyes in a higher amount is unfavorable because it retards the developability of the resulting grains.

Examples of the additives which are used in chemical ripening and spectral sensitization (color sensitization) of the emulsions of the present invention are described in *Research Disclosure* No. 17643 (December, 1978) and *Research Disclosure* No. 18716 (November, 1979), and the relevant parts of those disclosures are shown in Table I below.

Other known photographic additives which may be used in the present invention are described in these disclosures, and the relevant parts thereof are also shown in Table I.

In the present invention, the color sensitizing dye, antifoggant and stabilizer may be added to the photographic emulsion at any step during the formation of the emulsion, or they may be added to the emulsion at any stage after preparation of the emulsion but just before it is coated on a support. As examples of the former approach, the additives may be added during the step of forming silver halide grains, the step of physically ripening the grains, or the step of chemically ripening them. The color sensitizing dye, antifoggant and stabilizer may be used for the well known functions of such additives, but also for specifically defining the position at which the chemical-sensitizing nuclei are formed by utilizing the strong adsorbability of the additives to emulsions and other various characteristics thereof. They may also be used for forming junction structure grains having different halogen compositions and for stopping any excessive halogen conversion so as to maintain the intended hetero-halogen conjunction structure. Regarding this matter, descriptions in JP-A-55-26589, JP-A-58-111935, JP-A-58-28738 and JP-A-62-7040, and U.S. Pat. Nos. 3,628,960 and 4,225,666 are referred to.

It is preferred to previously add a part or all of the color sensitizing dye, antifoggant and stabilizer to be added to the emulsion and thereafter to add a chemical stabilizing agent to the emulsion for effecting the necessary chemical ripening of the emulsion, since the position of the chemically sensitized nuclei to be formed on the silver halide grain is restricted to only those portions to which the color sensitizing dye, antifoggant and stabilizer do not adsorb. Therefore diffusion or dispersion of the latent image to be formed may be prevented and the photographic characteristic of the emulsion is improved. In particular, when a sensitizing dye, an antifoggant and a stabilizer which selectively adsorb to the (111) plane of a hexagonal tabular silver halide grain are added, the chemically sensitized nuclei are, favorably, formed only on the edges of the grains.

In the present invention, it is also effective to perform the chemical sensitization of the silver halide grains in the presence of a silver halide solvent. Such a silver halide solvent is, for example, thiocyanate as well as the solvents described in JP-A-63-151618. The concentration of the solvent to be employed is preferably from $1\times10^{-5}$ to $1\times10^{-1}$ mol/liter.

The silver halide emulsion of the present invention may also be a system to be color-sensitized with antenna dyes. Color sensitization with antenna dyes is described in the disclosures of JP-A-62-209532, JP-A-63-138341 and JP-A-63-138342.

The silver halide photographic emulsion of the present invention may be silver iodobromide, silver iodochlorobromide or silver chloroiodobromide. Preferred is silver iodobromide or silver iodochlorobromide containing about 30 mol % or less silver iodide. Especially preferred is silver iodobromide containing approximately from 0.5 mol % to 15 mol %, more preferably from 1.5 mol % to 5 mol %, of silver iodide.

The silver iodide distribution in the silver halide grains may be uniform or may have a heterogeneous haloqen composition. Further, the silver halide grains may have a layered structure. Such emulsion grains are described in British Patent 1,027,146, U.S. Pat. Nos. 3,505,068 and 4,444,877 and JP-A-60-143331.

In particular, an emulsion having such a silver iodide distribution in which the surface silver iodide content is lower than the mean silver iodide content in the grain is preferred, since the solubility of the surface of the grain is higher so that the latent image to be formed on the inside of the grain may be developed more easily. For the same reason, silver halide grains having a high silver chloride content on the surface of the grain are also preferably employed in the present invention.

The silver iodide distribution in the grain may have one or more maximum values (peaks). It is preferred that the silver iodide content at the peak is two times or more, more preferably 4 times or more, of the mean silver iodide content in the whole grain. Most preferably, the peak is composed of a pure silver iodide.

The gradient of the variation of the silver iodide content to the peak value is preferably large. In the extreme case, the grain may have an epitaxial bond structure.

If desired, the grain of itself of the present invention may have different halogen compositions bonded to each other by epitaxial bond, or it may have compositions other than halogen compositions, such as silver rhodanide or lead oxide, bonded to the halogen composition matrix of the grain. The structures of such emulsion grains are disclosed in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

The silver halide grains of the photographic emulsions comprising the photographic material of the present invention may be so-called regular crystalline grains having a regular crystalline structure, such as cubic, octahedral or tetradecahedral grains, or irregular crystalline grains having an irregular crystalline structure, such as spherical or tabular grains, or irregular crystalline grains having a crystal defect, or composite crystalline grains composed of the above-mentioned regular and irregular crystalline forms. Regular crystalline grains are preferred because they permit easy control of the latent image distribution in the grains. Additionally, mixtures of various crystalline grains may also be used.

Tabular grains having an aspect ratio of 5 or more are also preferably used in the present invention.

Regarding the grain size of the silver halide grains, the grains may be fine having a small grain size of about 0.1 micron or less or may be large having a large grain size of up to about 10 microns, based on the diameter of the projected area.

The emulsion of the grains may be either a polydispersed emulsion having a large grain size distribution or a monodispersed emulsion having a narrow grain size distribution. In particular, the latter monodispersed emulsion is preferred, since it gives improved granularity.

A typical monodispersed emulsion is one in which at least 95% by weight of the grains have a grain size falling within the mean grain size plus/minus 40%. The mean grain size of the monodispersed grains is from 0.05 to 3 microns. In the present invention, a monodispersed emulsion is preferred in which at least 95% by weight or by number of the silver halide grains have a grain size falling within the mean grain size plus/minus 20%. Methods of preparing such a monodispersed emulsion are described in, for example, U.S. Pat. Nos. 3,574,628 and 3,655,394 and British Patent 1,412,748. Additionally, other monodispersed emulsions, for example, those described in JP-A-48-8600, JP-A-51-39027, JP-A-51-83097, JP-A-53-137133, JP-A-54-48521, JP-A-54-99419, JP-A-58-37635 and JP-A-58-49938 are also preferably used in the present invention.

The silver halide emulsion comprising regular grains to be used in the present invention can be obtained by properly controlling the pAg and pH values during the formation of the grains. The details of the technique are described, for example, in *Photographic Science and Engineering*, Vol. 6, pages 159 to 165 (1962); *Journal of Photographic Science*, Vol. 12, pages 242 to 251 (1964); and U.S. Pat. No. 3,655,394 and British Patent 1,413,748.

Tabular grains capable of being used in the present invention may be easily prepared by known methods, for example, those described in Gutoff, *Photographic Science and Engineering*, Vol. 14, pages 248 to 257 (1970), U.S. Pat. Nos. 4,434,226, 4,414,310, 4,433,048 and 4,439,520, and British Patent 2,112,157. Use of tabular grains is advantageous, because they elevate the coating capacity of the emulsion layer and elevate the color-sensitization efficiency of sensitizing dyes. This is mentioned in detail in U.S. Pat. No. 4,434,226.

The structure and manufacture of monodispersed hexagonal tabular grains for use in the present invention are mentioned in JP-A-63-151618. Briefly, the emulsion is a silver halide emulsion comprising a dispersing medium and silver halide grains. Seventy % or more of the total projected area of all silver halide grains in the emulsion are hexagonal tabular grains each having a ratio of the edge having the longest length to that having the shortest length of 2 or less. The hexagonal tabular grains each has two parallel planes as the outer surface thereof. The emulsion is monodispersed and has a variation coefficient of the grain size distribution of the hexagonal tabular silver halide grains in the emulsion (the variation coefficient being the value obtained by dividing the dispersion of the grain size represented by the diameter of a circle having an area corresponding to the projected area of the grain (standard deviation) by the mean grain size) of 20% or less. The hexagonal tabular silver halide grains in the monodispersed emulsion have an aspect ratio of 2.5 or more and a grain size of 0.2 micron or more.

A monodispersed silver halide emulsion for use in the present invention can be produced by the formation of grains, Ostwald ripening them and growth of the ripened grains. The details are described, for example, in JP-A-63-151618.

The tabular grains for use in the present invention are preferably prepared by increasing the speed of adding a silver salt solution (for example, aqueous $AgNO_3$ solution) and a halide solution (for example, aqueous KBr solution), increasing the amounts of the solutions and increasing the concentration of the solutions.

This method is disclosed in British Patent 1,335,925, U.S. Pat. Nos. 3,672,900, 3,650,757 and 4,242,445 and JP-A-55-142329 and JP-A-55-15812.

The silver halide photographic emulsion of the present invention can be prepared by any known method, in addition to the above-mentioned particular steps, for example, by the techniques disclosed in *Research Disclosure,* Vol. 176, No. 17643 (December 1978), pages 22 to 23 "I. Emulsion Preparation and Types" and *Research Disclosure,* Vol. 187, No. 18716 (November, 1979), page 648.

The photographic emulsions for use in the present invention may be prepared by the methods described in Glafkides, *Chemie et Physique Photographique* (published Paul Montel, 1967), G. F. Duffin, *Photographic Emulsion Chemistry* (published by Focal Press, 1966), and V. L. Zelikman et al., *Making and Coating Photographic Emulsion* (published by Focal Press, 1964). Specifically, they may be produced by any acid method, neutralization method and ammonia method. As a system for reacting a soluble silver salt and soluble halide(s), either a single jet method or a double jet method, or a combination of the two methods, may be employed. A so-called reverse mixing method for forming silver halide grains in the presence of excess silver ions may also be employed. As one system of a double jet method, the so-called controlled double jet method in which the pAg value in the liquid phase for forming silver halide grains is kept constant may also be employed. According to that method, a silver halide emulsion of grains having a regular crystalline form and having almost uniform grain sizes can be obtained.

The emulsion may be physically ripened in the presence of a known silver halide solvent (for example, ammonia, potassium thiocyanate, or thioethers or the thione compounds described in U.S. Pat. No. 3,271,157, JP-A-51-12360, JP-A-53-82408, JP-A-53-144319, JP-A-54-100717 and JP-A-54-155828).

Various compounds may be added to the reaction system during the step of precipitating and forming silver halide grains in the emulsion of the present invention, so as to control the properties of the silver halide grains formed. Such compounds may be added to the reaction container before initiation of the reaction, or may be added thereto during the addition of one or more reactant salts thereto during reaction by ordinary methods. For instance, in accordance with the disclosures of U.S. Pat. Nos. 2,448,060, 2,628,167, 3,737,313 and 3,772,031 and *Research Disclosure,* Vol. 134, No. 13452 (June, 1975), compounds of copper, iridium, lead, bismuth, cadmium, zinc (chalcogen compounds of sulfur, selenium or tellurium), gold or noble metals of the Group VII can be introduced during the step of precipitating and forming silver halide grains so as to control the characteristics of the silver halide grains formed. Additionally, in accordance with the disclosures of JP-B-58 1410 and Moisar et al., *Journal of Photographic Science,* Vol. 25 (1977), pages 19 to 27, the silver halide emulsion may be sensitized by reduction sensitization on the inside of the grains during the step of precipitating and forming the grains.

For the purpose of removing soluble silver salts from the emulsion before or after physical ripening thereof, the emulsion may be subjected to conventional noodle washing, flocculation or ultrafiltration.

In preparing the photographic material of the present invention, any known emulsions other than the chemically sensitized emulsion of the present invention may be used in the same layer containing the emulsion of the invention or in adjacent layers or in any other layers. When emulsions other than the chemically sensitized emulsion of the present invention are incorporated into the same layer as the emulsion of the invention, their proportion in the layer may properly be determined in accordance with the surface silver iodide content and object of the photographic material.

For instance, when two different emulsions are blended to form one layer, it is desired that the weight ratio of the two is from 3/97 to 97/3.

Two or more of the chemically sensitized emulsions of the present invention, which are different from each other with respect to their halogen composition, intragranular halogen distribution, grain size, grain size distribution, crystal form, crystal habit and latent image distribution, may be incorporated into the same layer, adjacent layers or other layers.

Accordingly, the present invention also provides a photographic material having at least one emulsion layer containing the above-mentioned silver halide emulsion chemically sensitized according to the present invention.

Apart from the above description, the photographic material of the present invention is not specifically limited, provided that it has at least one blue-sensitive silver halide emulsion layer, at least one green-sensitive silver halide emulsion layer and at least one red-sensitive silver halide emulsion layer on a support. The number of the silver halide emulsion layers and non-light-sensitive layers as well as the order of the layers on the support is not specifically limited. A typical example is a silver halide color photographic material having several light-sensitive layer units each composed of several silver halide emulsion layers each having substantially the same color-sensitivity but having a different sensitivity degree. The respective light-sensitive layers are unit light-sensitive layers each having a color-sensitivity to any of blue light, green light or red light. In such a multi-layer silver halide color photographic material, in general, the order of the light-sensitive layer units on the support comprises a red-sensitive layer unit, a green-sensitive layer unit and a blue-sensitive layer unit, formed on the support in this order. The order may be opposite to the above-mentioned one, in accordance with the object of the photographic material. In still another embodiment, a different color-sensitive layer may be sandwiched between other two of the same color-sensitive layers.

Various non-light-sensitive layers such as interlayers may be provided between the above-mentioned silver halide light-sensitive layers, or on or below the uppermost layer or lowermost light-sensitive layers.

Such an interlayer may contain various couplers and DIR compounds described in JP-A-61-43748, JP-A-59-113438, JP-A-59-113440, JP-A-61-20037 and JP-A-61-

20038, and it may also contain conventional color mixing preventing agents.

As the constitution of the plural silver halide emulsions of comprising the respective light-sensitive layer units, preferred is the two-layered constitution composed of a high-sensitivity emulsion layer and a low-sensitivity emulsion layer described in West German Patent 1,121,470 and British Patent 923,045. In general, it is preferred that the plurality of light-sensitive layers are arranged on the support in such a way that the sensitivity degree of the layers gradually decreases in the direction toward the support. In one embodiment, a non-light-sensitive layer may be provided between the plurality of silver halide emulsion layers. In another embodiment, a low-sensitivity emulsion layer is formed remote from the support and a high-sensitivity emulsion layer is formed near the support, as described in JP-A-57-112751, JP-A-62-200350, JP-A-62-206541, and JP-A-62-206543.

Examples of the layer constitution on the support include the order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; the order of BH/BL/GL/ GH/RH/RL; and the order of BH/BL/GH/GL/RL/RH.

Other examples include the order of blue-sensitive layer/GH/RH/GL/RL from the remotest side from the support, as described in JP-B-55-34932; and the order of blue-sensitive layer/GL/RL/GH/RH from the remotest side from the support, as described in JP-A-56-25738 and JP-A-62-63936.

A further example is the three-layer unit constitution described in JP-B-49-15495, wherein the uppermost layer is the highest-sensitivity silver halide emulsion layer, the intermediate layer is a silver halide emulsion layer having a lower sensitivity than the uppermost layer, and the lowermost layer is a silver halide emulsion layer having a still lower sensitivity than the intermediate layer. That is, in the layer constitution of that type, the sensitivity degree of each emulsion layer is gradually lowered in the direction of the support. Even in the three-layer constitution of that type, each of the same color-sensitivity layers may be composed of three layers of middle-sensitivity emulsion layer/high-sensitivity emulsion layer/low-sensitivity emulsion layer as formed in this order from the remotest side from the support, as described in JP-A-59-202464.

Still other examples of the layer constitution of the photographic material of the present invention include the order of high-sensitivity emulsion layer/low-sensitivity emulsion layer/middle-sensitivity emulsion layer, and the order of low-sensitivity emulsion layer/-middle-sensitivity emulsion layer/high-sensitivity emulsion layer.

When the photographic material of the invention has four or more layers, the layer constitution thereof may be varied in accordance with the manner mentioned above.

For the purpose of improving the color reproducibility of the photographic material of the invention, an interlayer effect donor layer (CL), which has a different color sensitivity distribution than the main light-sensitive layers of BL, GL and RL, is preferably arranged adjacent to or near the main light-sensitive layers as described in U.S. Pat. Nos. 4,663,271, 4,705,744, 4,707,436, JP-A-62-160448, and JP-A-63-89850.

As mentioned above, various layer constitutions and arrangements may be selected in accordance with the object of the photographic material of the invention.

Known photographic additives can be used in preparing the photographic material of the present invention, which are described in *Research Disclosure* Nos. 17643 and 18716. The relevant parts of the disclosures are mentioned below.

TABLE I

| Kind of Additives | RD 17643 | RD 18716 |
|---|---|---|
| 1. Chemical Sensitizer | Page 23 | Page 648, right column |
| 2. Sensitivity-enhancer | | Page 648, right column |
| 3. Spectral Sensitizer Super Color Sensitizer | Pages 23 to 24 | Page 648, right column to page 649, right column |
| 4. Brightening Agent | Page 24 | |
| 5. Anti-foggant Stabilizer | Pages 24 to 25 | Page 649, right column |
| 6. Light Absorbent Filter Dyes UV Absorbent | Pages 25 to 26 | Page 649, right column to page 650, left column |
| 7. Stain Inhibitor | Page 25, right column | Page 650, left column to right column |
| 8. Color Image Stabilizer | Page 25 | |
| 9. Hardening Agent | Page 26 | Page 651, left column |
| 10. Binder | Page 26 | Page 651, left column |
| 11. Plasticizer Lubricant | Page 27 | Page 650, right column |
| 12. Coating Aid Surfactant | Pages 26 to 27 | Page 650, right column |
| 13. Antistatic Agent | Page 27 | Page 650, right column |

In order to prevent deterioration of the photographic properties of the photographic material of the invention by formaldehyde gas, compounds capable of reacting with formaldehyde so as to solidify it, for example, those described in U.S. Pat. Nos. 4,411,987 and 4,435,503, are preferably incorporated into the material.

Various color couplers can be used in the present invention. Examples of appropriate color couplers are described in patent publications as referred to in the above-mentioned RD No. 17643, VII-C to G.

As yellow couplers, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,045, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT) 88/04795 are preferred.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162, 2,895,816, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred.

As colored couplers for correcting the unnecessary absorption of colored dyes, those described in RD No. 17643, VII-G, U.S. Pat. No. 4,163,670, JP-B-57-39413, U.S. Pat. Nos. 4,004,929, 4,138,258, and British Patent 1,146,368 are preferred. Additionally, couplers for correcting the unnecessary absorption of the colored dyed by the phosphor dye released during coupling, described in U.S. Pat. No. 4,774,181, as well as couplers having a dye precursor group capable of reacting with a developing agent to form a dyes, as a split-off groups, described in U.S. Pat. No. 4,777,120, are also preferable.

Couplers capable of forming colored dyes having an appropriate diffusibility may also be used, and those described in U.S. Pat. No. 4,366,237, British Patent 2,125,570, European Patent 96,570, and West German Patent OLS No. 3,234,533 are preferred.

Polymerized dye-forming couplers may also be used. Typical examples of such couplers are described in U.S. Pat. Nos. 3,451,820, 4,080,211, 4,367,282, 4,409,320, 4,576,910, British Patent 2,102,137, and European Patent 341,184A.

Couplers capable of releasing a photographically useful group during coupling may also be used in the present invention. For instance, as DIR couplers of releasing a development inhibitor, those described in the patent publications referred to in the above-mentioned RD No. 17643, Item VII-F as well as those described in JP-A-57-151944, JP-A-57-154234, JP-A-60-184248, JP-A-63-37346 and JP-A-63-37350 and U.S. Pat. Nos. 4,248,962 and 4,782,012 are preferred.

As couplers for imagewise releasing a nucleating agent or a development accelerator during development, those described in British Patents 2,097,140 and 2,131,188, and JP-A-59-157638 and JP-A-59-170840 are preferred.

Additionally, examples of couplers which may be incorporated into the photographic materials of the present invention include competing couplers described in U.S. Pat. No. 4,130,427; polyvalent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers capable of releasing a dye which recolors after being released from the coupler, as described in European Patents 173,302A and 313,308A; bleaching accelerator-releasing couplers as described in RD Nos. 11449 and 24241, and JP-A-61-201247; ligand-releasing couplers described in U.S. Pat. No. 4,553,477; leuco dye-releasing couplers described in JP-A-63-75747; and couplers capable of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for that purpose. Examples of high boiling point solvents appropriate for that method are described in U.S. Pat. No. 2,322,027.

Examples of high boiling point organic solvents having a boiling point of 175° C. or higher at normal pressure, which are used in an oil-in-water dispersion include phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C., can be used. Examples of such auxiliary organic solvents include ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes appropriate in that method are described in U.S. Pat. No. 4,199,363, West German Patent (OLS) Nos. 2,541,174 and 2,541,130.

The color photographic materials of the present invention preferably contain various antiseptics or fungicides, for example, those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, typical examples include color negative films for general use or movie use, color reversal films for slide use or television use, as well as color papers, color positive films and color reversal papers.

Suitable supports which are suitable for the present invention are described in, for example, the above-mentioned RD No. 17643, page 28, and RD No. 18716, from page 647, right column to page 648, left column.

It is desired that the total film thickness of all the hydrophilic colloid layers provided on the surface of the support of having emulsion layers is 28 microns or less, preferably 23 microns or less, more preferably 20 microns or less. It is also desired that the photographic material of the invention has a film swelling rate ($T_{\frac{1}{2}}$) of 30 seconds or less, preferably 20 seconds or less. The film thickness as referred to herein is one measured under the controlled conditions of a temperature of 25° C. and a relative humidity of 55% (for 2 days); and the film swelling rate as referred to herein may be measured by any means known in this technical field. For instance, it may be measured by the use of a swellometer of the model as described in A. Green et al., *Photographic Science Engineering, Vol.* 19, No. 2, pages 124 to 129. The film swelling rate ($T_{\frac{1}{2}}$) is defined as follows: 90% of the maximum swollen thickness of the photographic material as processed in a color developer under the conditions of 30° C. and 3 minutes and 15 seconds is called a saturated swollen thickness. The time necessary for attaining a half (½) of the saturated swollen thickness is defined to be a film swelling rate ($T_{\frac{1}{2}}$).

The film swelling rate ($T_{\frac{1}{2}}$) can be adjusted by adding a hardening agent to the gelatin of the binder or by varying the conditions of storing the coated photographic material. Additionally, the photographic material of the present invention is desired to have a swelling degree of from 150 to 400%. The swelling degree as referred to herein is calculated from the maximum swollen film thickness obtained under the above-mentioned conditions, on the basis of a formula of:

(maximum wollen film thickness − original film thickness)/(original film thickness).

The color photographic material of the present invention can be developed by any ordinary method, for example, in accordance with the process described in the above-mentioned RD No. 17643, pages 28 and 29 and RD No. 18716, page 615, from left column to right column.

The color developer used for development of the photographic material of the present invention is preferably an aqueous alkaline solution consisting essentially of an aromatic primary amine color-developing agent. As the color-developing agent, p-phenylenediamine compounds are preferable, though aminophenol compounds are also useful. Specific examples of p-phenylenediamine compounds suitable as the color-developing agent include 3-methyl-4-amino-N,N-diethylaniline, 3-mehtyl-4-amino N-ethyl-N-β-hydroxyethylaniline, 3-methyl-4-amino-N-ethyl-N-β-methanesulfoneamidoethylaniline, 3-methyl-4-amino-N-ethyl-N-β-methoxyethylaniline, as well as sulfates, hydrochlorides and p-toluenesulfonates of the compounds. These compounds can be used in combination of two or more, in accordance with the object.

The color developer generally contains a pH buffer such as alkali metal carbonates, borates or phosphates, and a development inhibitor or anti-foggant such as bromides, iodides, benzimidazoles, benzothiazoles or mercapto compounds. If desired, it may also contain preservatives such as hydroxylamine, diethylhydroxylamine, sulfites, hydrazines, phenylsemicarbazides, triethanolamine, catechol-sulfonic acids, and triethylenediamine(1,4-diazabicyclo[2,2,2]octane); an organic solvent such as ethylene glycol, and diethylene glycol; a development accelerator such as benzyl alcohol, polyethylene glycol, quaternary ammonium salts, and amines; a dye-forming coupler; a competing coupler; a foggant such as sodium boronhydride; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. Examples of the chelating agents which may be incorporated into the color developer include ethylenediamine-tetraacetic acid, nitrilo-triacetic acid, diethylenetriaminepentaacetic acid, cyclohexanediamine-tetraacetic acid, hydroxylethylimino-diacetic acid, 1-hydroxyethylidene-1,1-diphosphonic acid, nitrilo-N,N,N-trimethylenephosphonic acid, ethylenediamine-N,N,N',N'-tetramethylene-phosphonic acid, ethylenediamine-di(o-hydroxyphenylacetic acid) and their salts.

When the photographic material is processed for reversal finish, in general, it is first subjected to black-and-white development and then subjected to color development. For the first black-and-white development, a black-and-white developer is used which contains a conventional black-and-white developing agent, for example, dihydroxybenzenes such as hydroquinone, 3-pyraozlidones such as 1-phenyl-3-pyraozlidone, or aminophenols such as N-methyl-p-aminophenol, either singly or in combination of them.

The color developer and the black-and-white developer generally has a pH value of from 9 to 12. The amount of the replenisher to the developer is, though depending upon the color photographic material to be processed, generally 3 liters or less per $m^2$ of the material to be processed. It may be reduced to 500 ml or less per $m^2$ of the material to be processed, by lowering the bromide ion concentration in the replenisher. When the amount of the replenisher is reduced, it is preferred to reduce the contact area of the surface of the processing solution in the processing tank with air so as to prevent vaporization and aerial oxidation of the solution. If desired, the amount of the replenisher may also be reduced by employing a means of preventing accumulation of bromide ion in the developer being used.

After being color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of two continuous tanks, a system of fixation followed by bleach-fixation, or a system of bleach-fixation followed by bleaching may also be employed, in accordance with the object.

The bleaching agent can be, for example, compounds of polyvalent metals such as iron(III), cobalt(III), chromium(IV) or copper(II), as well as peracids, quinones and nitro compounds. Specific examples of suitable bleaching agents are ferricyanides; bichromates; organic complexes of iron(III) or cobalt(III), for example, with aminopolycarboxylic acids such as ethylenediaminetetraacetic acid, diethylenetriaminepentaacetic acid, cyclohexanediamine-tetraacetic acid, methylimino-diacetic acid, 1,3-diaminopropanetetraacetic acid or glycoletherdiamine-tetraacetic acid, or with citric acid, tartaric acid or malic acid; persulfates; bromates; permanganates; and nitrobenzenes. Aminopolycarboxylato/iron(III) complexes such as ethylenediaminetetraacetato/iron(III) complex as well as persulfates are especially preferred, as being suitable for rapid processing and being free from environmental pollution. Additionally, aminopolycarboxylato/iron(III) complexes are especially useful both in a bleaching solution and in a bleach-fixing solution. The bleaching solution or bleach-fixing solution containing such an aminopolycarboxylato/iron(III) complex generally has a pH value of from 5.5 to 8, but it may have an even lower pH value for the purpose of accelerating the bleaching or bleach-fixing procedure with the solution.

Suitable as a fixing agent are thiosulfates, thiocyanates, thioether compounds, thioureas and a large amount of iodides. Use of thiosulfates is common. In particular, ammonium thiosulfate is most widely used. As a preservative in the bleach-fixing solution, preferred are sulfites, bisulfites, and carbonyl-bisulfite adducts.

The silver halide color photographic material of the present invention is, after being desilvered, generally rinsed in water and/or stabilized. The amount of the water to be used in the rinsing step varies, depending upon the characteristics of the photographic material being processed (for example, the constituting elements such as couplers and others), the use of the material, the temperature of the rinsing water, the number of the rinsing bathes (the number of rinsing stages), the replenishment system of normal current or countercurrent, and other various conditions, and therefore it may be selected over a broad range. For instance, the relation between the number of the rinsing tanks and the amount of the rinsing water in a multi-stage countercurrent rinsing system may be obtained by the method described in *Journal of the Society of Motion Picture and Television Enqineering,* Vol. 64, pages 248 to 253 (May, 1955).

In processing the photographic material of the present invention, the rinsing water has a pH value of from 4 to 9, preferably from 5 to 8. The temperature of the rinsing water and the rinsing time may be determined in accordance with the characteristics and use of the photographic material being processed. In general, the temperature is from 15° to 45° C., and the time is from 20 seconds to 10 minutes; and preferably, the former is from 25° to 40° C. and the latter is from 30 seconds to 5 minutes. If desired, the photographic material of the present invention can be directly processed with a stabilizer in place of the above-mentioned rinsing step. In carrying out the stabilizing step, any known means, for example, those described in JP-A-57-8543, JP-A-58-4834 and JP-A-60-220345 can be employed.

Stabilization may additionally be effected after the rinsing step. One example is a stabilizing bath which contains formaldehyde and a surfactant and which is used as a final bath for processing picture-taking color photographic materials. The stabilizing bath may also contain various chelating agents and fungicides.

The overflow resulting from replenishment to the above-mentioned rinsing water and/or stabilizer may be re-used in the previous steps such as the desilvering steps.

In processing the photographic material of the present invention, various processing solutions are used at a temperature of 10° C. to 50° C. In general, the processing temperature is within the range of 33° C. and 38° C. A higher processing temperature may be employed for the purpose of accelerating that process so as to shorten the processing time; or on the contrary, a lower processing temperature may be employed for the purpose of improving the quality of images formed or elevating the stability of the processing solution.

When the material of the invention is a black-and-white photographic material, it may be developed with various known developing agents. For instance, suitable developing agents are polyhydroxybenzenes such as hydroquinone, 2-chlorohydroquinone, 2-methylhydroquinone, catechol, and pyrogallol; aminophenols such as p-aminophenol, N-methyl-p-aminophenol, and 2,4-diaminophenol; 3-pyrazolidones such as 1-phenyl-3-pyrazolidone, 1-phenyl-4,4'-dimethyl-3-pyrazolidone, 1-phenyl-4-methyl-4-hydroxymethyl-3-pyrazolidone, and 5,5-dimethyl-1-phenyl-3-pyrazolidone; and ascorbic acids. These may be used singly or in combination of two or more. Additionally, the developers described in JP-A-58-55928 may also be used.

Detailed examples and uses of developing agents, preservatives, buffers and developing methods for black-and-white photographic materials are described in Research Disclosure No. 17643 (December, 1978), XIX to XXI.

The present invention will now be explained in more detail by way of the following examples, which, however, are not intended to restrict the scope of the present invention. Unless otherwise indicated, all parts, percents, ratios and the like are by weight.

EXAMPLE 1

Preparation of Emulsions

Emulsion L

Eight hundred cc of aqueous 15% silver nitrate solution and an aqueous solution containing 0.85 mol/liter of KBr and 0.031 mol/liter of KI were added to 1,560 cc of aqueous gelatin solution (3.4%) kept at 72° C., at a pH of 6.8 and a silver potential (SCE) of +30 mV, over a period of 30 minutes by a double jet method, to prepare a monodispersed emulsion of silver halide grains with (100) crystal habit (the length of the edge of the grain was 0.20 micron). Next, to the core emulsion thus prepared, were added 2.1 mg of Compound A-5 of a sulfur sensitizer, 1.3 mg of sodium chloroaurate of a gold sensitizer, 4.3 mg of Compound A-2 and 0.3 mg of Compound A-3. Whereupon, the emulsion was chemically sensitized at a pH of 6.8 and an SCE of +30 mV for 55 minutes. Next, 0.14 g of Compound A-1 and 0.3 g of Compound A-4 were added thereto, and then the temperature of the emulsion was lowered to 50° C. Again 200 cc of aqueous 15% silver nitrate solution and an aqueous solution containing 0.85 mol/liter of KBr and 0.031 mol/liter of KI were added thereto at a pH of 6.8 and an SCE of +30 mV over a period of 5 minutes to form shells over the core grains. Thus, the grains formed had a final size of 0.22 micron and a mean silver iodide content of 3.5 mol %. The emulsion was subjected to conventional flocculation to remove soluble silver salts therefrom. Accordingly, Emulsion L was prepared.

Emulsion J

Emulsion J was prepared in the same manner as Emulsion L, except that the sensitizers were added after removal of soluble silver salts and the emulsion was chemically sensitized at a pH of 6.7 for 55 minutes. The amounts of the sensitizers added in preparing Emulsion J were 1.2 times those added to Emulsion L, to obtain the optimum fog sensitivity.

Emulsions A, D, K, and M to T

Emulsions K and M were prepared in the same manner as Emulsions J and L, respectively, except that $2\times10^{-6}$ mol per mol of silver of $Au_2Se_3$ was added to the emulsion at the point in time when the grain size became 0.15 micron. Emulsions A and D were also prepared in the same manner as Emulsions J and L, respectively, except that $2\times10^{-6}$ mol per mol of silver of $K_2[PdCl_6]$ was added to the emulsion at the point in time when the grain size became 0.15 micron. Next, Emulsions N to T were prepared in the same manner as Emulsion D, except that the amount of $K_2[PdCl_6]$ added was varied from $2\times10^{-6}$ to $2\times10^{-2}$ mol per mol of silver.

Emulsions C and E

Emulsion C was prepared in the same manner as Emulsion D, except that the SCE condition of forming shells was converted from +30 mV to +85 mV; and Emulsion E was also prepared in the same manner as Emulsion D, except that the SCE condition of forming shells was converted from +30 mV to −40 mV.

Emulsions B, F, G, H and I

Emulsions B, F, G, H and I were prepared in the same manner as Emulsion D, except that the amounts of the aqueous silver nitrate solution to be used both in forming cores and in forming shells were varied.

All the emulsions thus prepared are shown in Table 1-1 below.

Compounds used in preparing the emulsions were as follows:

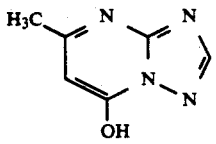
A-1

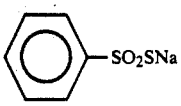
A-2

$K_2IrCl_6$ A-3

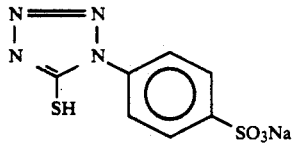
A-4

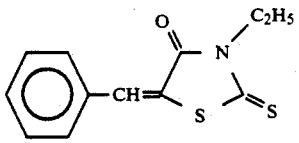
A-5

TABLE 1-1

| Emulsion | Chemically sensitized Position (depth from surface) (μm) | Ratio of Number of Surface Latent Images to Maximum value(*) | Compound Added | Amount of Compound Added (mol/mol of Ag) |
|---|---|---|---|---|
| A | 0 | 1 | $K_2[PdCl_6]$ | $2 \times 10^{-6}$ |
| B | 0.005 | 0.7 | " | " |
| C | 0.01 | 0.5 | " | " |
| D | 0.01 | 0.3 | " | " |
| E | 0.01 | 0.1 | " | " |
| F | 0.018 | 0.4 | " | " |
| G | 0.025 | 0.3 | " | " |
| H | 0.04 | 0.1 | " | " |
| I | 0.04 | 0.5 | " | " |
| J | 0 | 1 | — | — |
| K | 0 | 1 | $Au_2Se_3$ | $2 \times 10^{-6}$ |
| L | 0.01 | 0.3 | — | — |
| M | 0.01 | 0.3 | $Au_2Se_3$ | $2 \times 10^{-6}$ |
| N | 0.01 | 0.3 | $K_2[PdCl_6]$ | $2 \times 10^{-10}$ |
| O | 0.01 | 0.3 | " | $2 \times 10^{-9}$ |
| P | 0.01 | 0.3 | " | $2 \times 10^{-7}$ |
| Q | 0.01 | 0.3 | " | $2 \times 10^{-5}$ |
| R | 0.01 | 0.3 | " | $2 \times 10^{-4}$ |
| S | 0.01 | 0.3 | " | $2 \times 10^{-3}$ |
| T | 0.01 | 0.3 | " | $2 \times 10^{-2}$ |

(*)Obtained by the method described hereinbefore.

To each of the above-mentioned emulsions was added Sensitizing Dye S-1 (identified in Example 2). The resulting emulsions were individually coated on a support each in an amount of 2 μg per $cm^2$ to prepare Samples Nos. 101 to 120.

These samples were developed with the following developer at 20° C. for 7 minutes, then fixed, rinsed and dried. The density of each of the thus processed samples was sensitometrically measured.

| | |
|---|---|
| Developer: | |
| 1-Phenyl-3-pyrazolidone | 0.5 g |
| Hydroquinone | 10 g |
| Disodium Ethylenediaminetetraacetate | 2 g |
| Potassium Sulfite | 60 g |
| Boric Acid | 4 g |
| Potassium Carbonate | 20 g |
| Sodium Bromide | 5 g |
| Diethylene Glycol | 20 g |
| Sodium Hydroxide to make | pH of 10.0 |
| Water to make | 1 liter |
| Fixing Solution: | |
| Ammonium Thiosulfate | 240.0 g |
| Sodium Sulfite (anhydride) | 15.0 g |
| Acetic Acid (28%) | 48 ml |
| Sodium Metaborate | 15 g |
| Potassium Alum | 15 g |
| Water to make | 1 liter |

The results of sensitometry of the samples are shown in Table 1-2 below, wherein the sensitivity is represented by a relative value ($S_{0.1}$) of the reciprocal of the amount of exposure giving a density of (fog+0.1).

TABLE 1-2

| Sample | Emulsion | Remarks | $S_{0.1}$ |
|---|---|---|---|
| 101 | A | Comparative sample | −0.25 |
| 102 | B | Sample of the invention | −0.10 |
| 103 | C | " | −0.05 |
| 104 | D | " | ±0 |
| 105 | E | " | −0.10 |
| 106 | F | " | −0.06 |
| 107 | G | Comparative sample | −0.15 |
| 108 | H | " | −0.40 |
| 109 | I | " | −0.25 |
| 110 | J | " | −0.36 |
| 111 | K | " | −0.28 |
| 112 | L | " | −0.19 |
| 113 | M | " | −0.13 |
| 114 | N | " | −0.12 |
| 115 | O | Sample of the invention | −0.08 |
| 116 | P | " | −0.05 |
| 117 | Q | " | −0.02 |
| 118 | R | " | −0.03 |
| 119 | S | " | −0.09 |
| 120 | T | Comparative sample | −0.20 |

From the results in Table 1-2 above, it is understood that the samples to which Pd was added during formation of grains have a high sensitivity. The effect of elevating the sensitivity by addition of Pd is more remarkable when it is added to an emulsion having a latent image distribution at a depth of 0.01 micrometer from the surface of the grain (comparison of Sample 112 with Sample 104) than when it is added to an emulsion containing grains chemically sensitized at their surfaces (comparison of Sample 110 with Sample 101). In addition, it is also noted that the sensitivity is relatively lower in the case where the maximum value (peak) of the latent image distribution is in the position farther than 0.2 micrometer from the surface of the grain (comparison of Sample 107 with Sample 109).

The effects of the present invention varies in accordance with the number of the surface latent images, and when the ratio of the number of the surface latent images is small (as Sample 105), the sensitivity is also relatively lower.

Further, it is also noted that when the amount of the Pd compound added is too large or more than $2\times10^{-2}$ mol/mol of Ag, or too small or less than $2\times10^{-10}$ mol/mol of Ag, the sensitivity is lowered by more than 0.1 (as a relative value). Therefore, the most preferred amount of the Pd compound is from $10^{-6}$ to $10^{-4}$ mol/mol of Ag.

EXAMPLE 2

Preparation of Sample 201

The several layers mentioned below were coated on a subbing layer-coated cellulose triacetate (film support having a thickness of 127 microns to prepare a multilayer color photographic material sample (Sample 201). The amount of each component mentioned below is per $m^2$. The functions of the compounds added are not limited to only those mentioned below.

| | |
|---|---|
| First Layer: Anti-halation Layer | |
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-6 | 0.1 g |
| High Boiling Point Organic Solvent Oil-1 | 0.1 g |
| Second Layer: Interlayer | |
| Gelatin | 0.40 g |
| Dye D-4 | 0.4 mg |
| Third Layer: Interlayer | |
| Emulsion of Fine Silver Iodobromide Grains (both surfaces and insides fogged; mean grain size 0.06 micron; variation coefficient 18%; AgI content 1 mol %) | 0.05 g as Ag |
| Gelatin | 0.4 g |
| Fourth Layer: Low-sensitivity Red-sensitive Emulsion Layer | |
| Emulsion A | 0.2 g as Ag |
| Emulsion B | 0.3 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High Boiling Point Organic Solvent Oil-2 | 0.1 g |
| Fifth Layer: Middle-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High Boiling Point Organic Solvent Oil-2 | 0.1 g |
| Sixth Layer: High-sensitivity Red-sensitive Emulsion Layer | |
| Emulsion D | 0.4 g as Ag |
| Gelatin | 1.1 g |
| Coupler C-3 | 0.7 g |
| Coupler C-1 | 0.3 g |
| Additive P-1 | 0.1 g |
| Seventh Layer: Interlayer | |
| Gelatin | 0.6 g |
| Additive M-1 | 0.3 g |
| Color Mixing Preventing Agent Cpd-K | 2.6 mg |
| Ultraviolet Absorbent U-1 | 0.1 g |
| Ultraviolet Absorbent U-6 | 0.1 g |
| Dye D-1 | 0.02 g |
| Eighth Layer: Interlayer | |

-continued

| | |
|---|---|
| Emulsion of Fine Silver Iodobromide Grains (both surfaces and insides fogged; mean grain size 0.06 micron; variation coefficient 16%; AgI content 0.3 mol %) | 0.02 g as Ag |
| Gelatin | 1.0 g |
| Additive P-1 | 0.2 g |
| Color Mixing Preventing Agent Cpd-J | 0.1 g |
| Color Mixing Preventing Agent Cpd-A | 0.1 g |
| Ninth Layer: Low-sensitivity Green-sensitive Emulsion Layer | |
| Emulsion E | 0.3 g as Ag |
| Emulsion F | 0.1 g as Ag |
| Emulsion G | 0.1 g as Ag |
| Gelatin | 0.5 g |
| Coupler C-4 | 0.2 g |
| Coupler C-7 | 0.1 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.02 g |
| Compouhd Cpd-H | 0.02 g |
| Compound Cpd-D | 10 mg |
| High Boiling Point Organic Solvent Oil-1 | 0.1 g |
| High Boiling Point Organic Solvent Oil-2 | 0.1 g |
| Tenth Layer: Middle-sensitivity Green-sensitive Emulsion Layer | |
| Emulsion G | 0.3 g as Ag |
| Emulsion H | 0.1 g as Ag |
| Gelatin | 0.6 g |
| Coupler C-4 | 0.1 g |
| Coupler C-7 | 0.1 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High Boiling Point Organic Solvent Oil-2 | 0.01 g |
| Eleventh Layer: High-sensitivity Green-sensitive Emulsion Layer | |
| Emulsion I | 0.5 g as Ag |
| Gelatin | 1.0 g |
| Coupler C-8 | 0.1 g |
| Coupler C-4 | 0.3 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High Boiling Point Organic Solvent Oil-1 | 0.02 g |
| High Boiling Point Organic Solvent Oil-2 | 0.02 g |
| Twelfth Layer: Interlayer | |
| Gelatin | 0.6 g |
| Dye D-2 | 0.05 g |
| Dye D-1 | 0.1 g |
| Dye D-3 | 0.07 g |
| Thirteenth Layer: Yellow Filter Layer | |
| Yellow Colloidal Silver | 0.1 g as Ag |
| Gelatin | 1.1 g |
| Color Mixing Preventing Agent Cpd-A | 0.01 g |
| High Boiling Point Organic Solvent Oil-1 | 0.01 g |
| Fourteenth Layer: Interlayer | |
| Gelatin | 0.6 g |
| Fifteenth Layer: Low-sensitivity Blue-sensitive Emulsion Layer | |
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |
| Sixteenth Layer: Middle-sensitivity Blue-sensitive Emulsion Layer | |

-continued

| | |
|---|---|
| Emulsion L | 0.1 g as Ag |
| Emulsion M | 0.4 g as Ag |
| Gelatin | 0.9 g |
| Coupler C-5 | 0.3 g |
| Coupler C-6 | 0.3 g |
| Seventeenth Layer: High-sensitivity Blue-sensitive Emulsion Layer | |
| Emulsion N | 0.4 g as Ag |
| Gelatin | 1.2 g |
| Coupler C-6 | 0.7 g |
| Eighteenth Layer: First Protective Layer | |
| Gelatin | 0.7 g |
| Ultraviolet Absorbent U-1 | 0.04 g |
| Ultraviolet Absorbent U-2 | 0.01 g |
| Ultraviolet Absorbent U-3 | 0.03 g |
| Ultraviolet Absorbent U-4 | 0.03 g |
| Ultraviolet Absorbent U-5 | 0.05 g |
| Ultraviolet Absorbent U-6 | 0.05 g |
| High Boiling Point Organic Solvent Oil-1 | 0.02 g |
| Formaldehyde Scavenger Cpd-C | 0.2 g |
| Additive Cpd-1 | 0.4 g |
| Dye D-3 | 0.05 g |
| Nineteenth Layer: Second Protective layer | |
| Colloidal Silver | 0.1 mg as Ag |
| Emulsion of Fine Silver Iodobromide Grains (mean grain size 0.06 micron; AgI content 1 mol %) | 0.1 g as Ag |
| Gelatin | 0.4 g |
| Twentieth Layer: Third Protective Layer | |
| Gelatin | 0.4 g |
| Polymethyl Methacrylate (mean grain size 1.5 microns) | 0.1 g |
| 4/6 (by mol) Copolymer of Methyl Methacrylate and Acrylic Acid (mean grain size 1.5 microns) | 0.1 g |
| Silicone Oil | 0.03 g |
| Surfactant W-1 | 3.0 mg |
| Surfactant W-2 | 0.03 g |

To all the emulsion layers were added Additives (F-1) to (F-7) in addition to the above-mentioned components. Further, all the layers contained Gelatin Hardening Agent (H-1), Coating Aid Surfactant (W-3) and Emulsification Aid Surfactant (W-4), in addition to the above-mentioned components.

Silver iodobromide emulsions used in preparing Sample 201 are mentioned below.

Additionally, phenol, 1,2-benzisothiazolin-3-one, 2-phenoxyethanol and phenethyl alcohol were added to each layer of Sample 201 as antiseptic and antifungal agents.

TABLE 2-1

| Emulsion | Characteristic of Grains | Mean Grain size (μm) | Variation Coefficient (%) | AgI Content (%) | AgI Composition Structure |
|---|---|---|---|---|---|
| A | Monodispersed 14-hedral grains | 0.50 | 16 | 3.2 | Two-layered structure with AgI-poor surface |
| B | Monodispersed internal latent image type cubic grains | 0.62 | 6 | 3.3 | Two-layered structure with AgI-poor surface |
| C | Monodispersed 14-hedral grains | 0.80 | 18 | 5.0 | Three-layered structure* |
| D | Polydispersed tabular grains with mean aspect ratio of 3.5 | 1.20 | 25 | 8.0 | Uniform |
| E | Monodispersed internal latent image type cubic grains | 0.32 | 17 | 4.0 | " |
| F | Monodispersed internal latent image type cubic grains | 0.45 | 16 | 4.0 | Two-layered structure with AgI-poor surface |
| G | Monodispersed internal latent image type 14-hedral grains | 0.54 | 7 | 3.5 | Two-layered structure with AgI-poor surface |
| H | Monodispersed internal latent image type 8-hedral grains | 0.70 | 9 | 3.5 | Two-layered structure with AgI-poor surface |
| I | Monodispersed internal latent image type tabular grains | 1.40 | 17 | 1.5 | Three-layered structure* |
| J | Monodispersed 14-hedral grains | 0.63 | 18 | 4.0 | " |
| K | Monodispersed internal latent image type 14-hedral grains | 0.73 | 17 | 8.0 | Three-layered structure* |
| L | Monodispersed internal latent image type 8-hedral grains | 0.90 | 14 | 12.0 | " |
| M | Monodispersed tabular grains with mean aspect ratio of 4.0 | 1.50 | 18 | 6.0 | " |
| N | Polydispersed tabular grains with mean aspect ratio of 4.5 | 1.90 | 33 | 1.3 | " |

*Three-layered structure is composed of AgI-poor core/AgI-rich interlayer/AgI-poor surface shell, and the AgI content in the AgI-rich part was from 15 to 100%.

All the above-mentioned internal latent image type grains were chemically sensitized on the inside of the grain so that the maximum value (peak) of the latent image distribution was to a depth less than 0.02 micrometer from the surface of the grain.

TABLE 2-2

Color Sensitization of Emulsions A to N

| Emulsion | Sensitizing Dyes Added | Amount of Added Dyes (g) per mol of Silver Halide | Time of Addition of Sensitizing Dyes |
|---|---|---|---|
| A | S-1 | 0.025 | Just after chemical sensitization |
| | S-2 | 0.25 | Just after chemical sensitization |
| B | S-1 | 0.01 | Just after formation of grains |
| | S-2 | 0.25 | Just after formation of grains |
| C | S-1 | 0.02 | Just after chemical sensitization |
| | S-2 | 0.25 | Just after chemical sensitization |
| D | S-1 | 0.01 | Just after chemical sensitization |
| | S-2 | 0.10 | Just after chemical sensitization |

TABLE 2-2-continued

| Emulsion | Sensitizing Dyes Added | Color Sensitization of Emulsions A to N: Amount of Added Dyes (g) per mol of Silver Halide | Time of Addition of Sensitizing Dyes |
|---|---|---|---|
| | S-7 | 0.01 | Just after chemical sensitization |
| E | S-3 | 0.5 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after formation of grains |
| | S-4 | 0.08 | Just after formation of grains |
| H | S-3 | 0.2 | During formation of grains |
| | S-4 | 0.06 | During formation of grains |
| I | S-3 | 0.3 | Just before chemical sensitization |
| | S-4 | 0.07 | Just before chemical sensitization |
| | S-8 | 0.1 | Just before chemical sensitization |
| J | S-5 | 0.2 | During formation of grains |
| | S-6 | 0.05 | During formation of grains |
| K | S-5 | 0.2 | During formation of grains |
| | S-6 | 0.05 | During formation of grains |
| L | S-5 | 0.22 | Just after formation of grains |
| | S-6 | 0.06 | Just after formation of grains |
| M | S-5 | 0.15 | Just after chemical sensitization |
| | S-6 | 0.04 | Just after chemical sensitization |
| N | S-5 | 0.22 | Just after formation of grains |
| | S-6 | 0.06 | Just after formation of grains |

The components used in preparing Sample 201 are shown below.

C-1

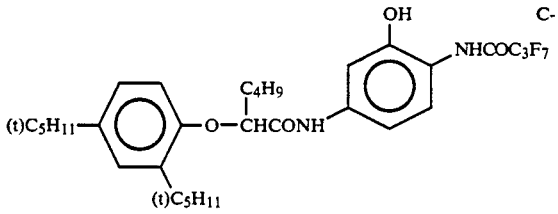

C-2

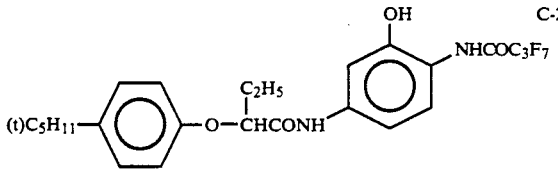

C-3

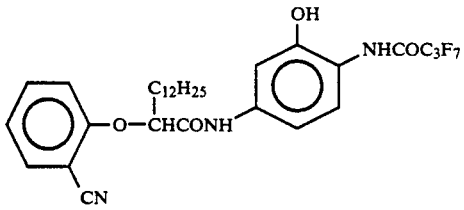

C-4

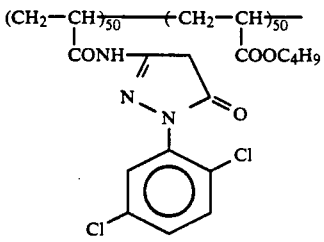

Number means by weight.
Mean molecular weight:
about 25,000

-continued

C-5

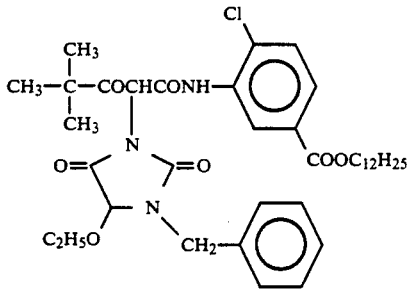

C-6

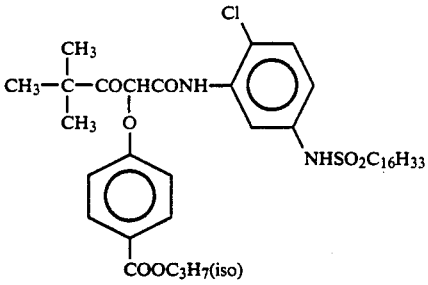

C-7

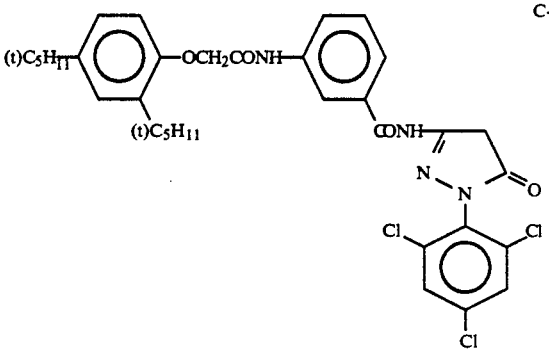

-continued
C-8
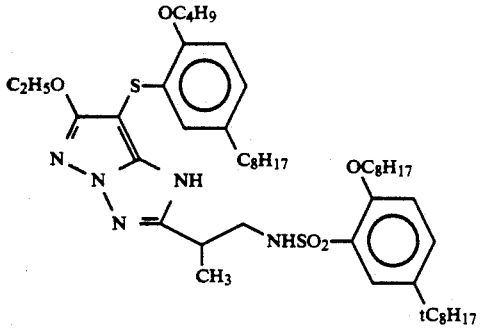
C-9
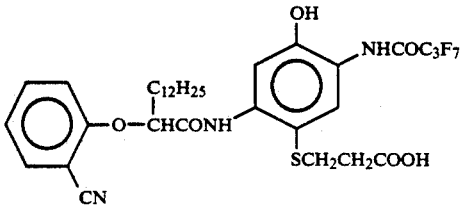
Dibutyl phthalate Oil-1
Tricresyl phosphate Oil-2
Oil-3
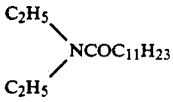
Cpd-A
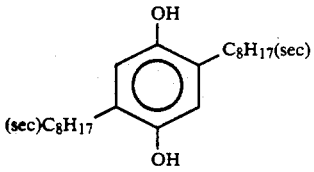
Cpd-B
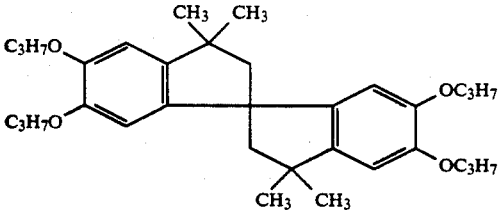
Cpd-C
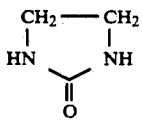
Cpd-D
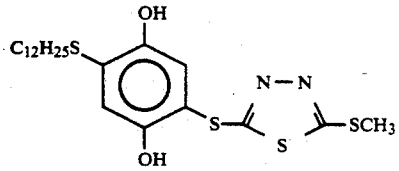
-continued
Cpd-E
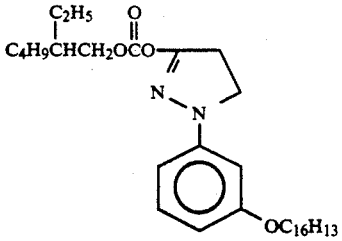
Cpd-F
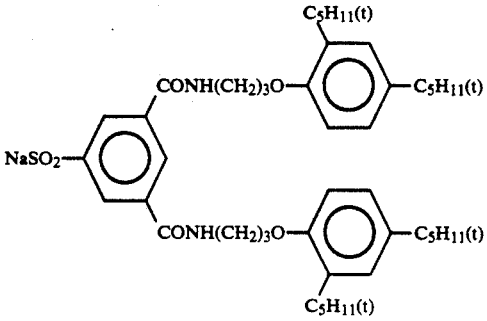
Cpd-G
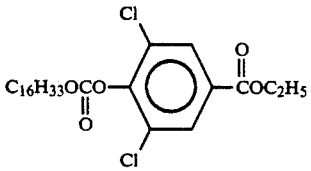
Cpd-H
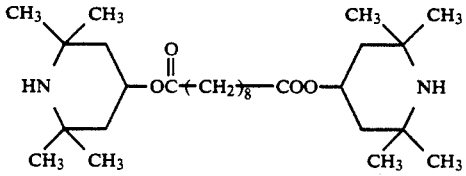
Cpd-I
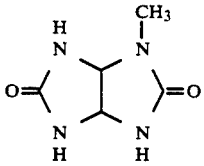
Cpd-J
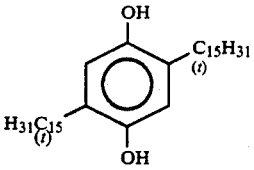
Cpd-K
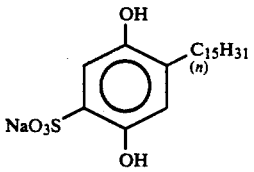
U-1
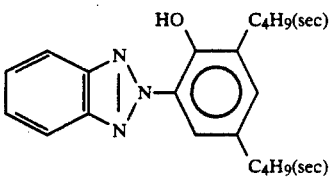

-continued
U-2
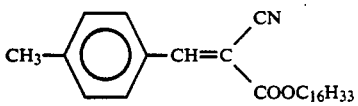
U-3
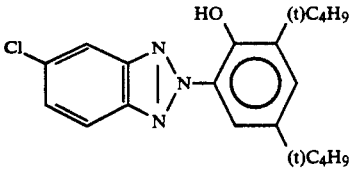
U-4
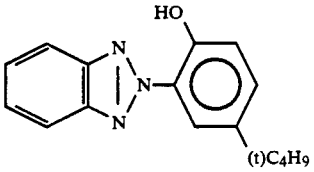
U-5
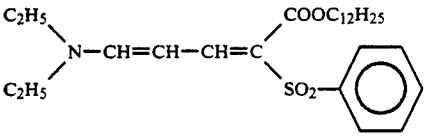
U-6
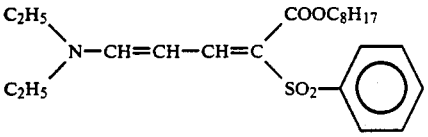
S-1
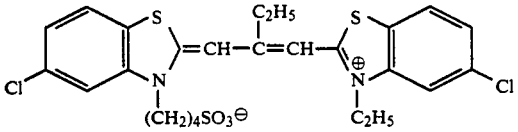
S-2
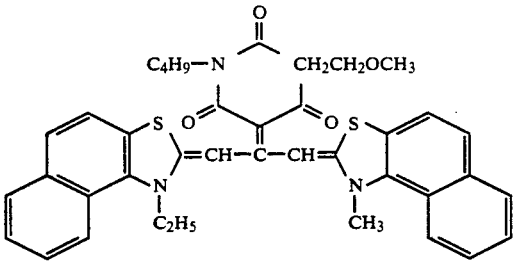
S-3
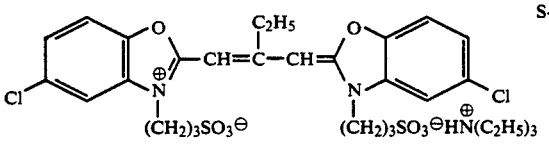
S-4
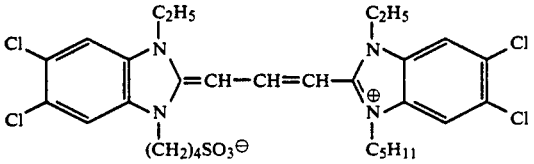
-continued
S-5
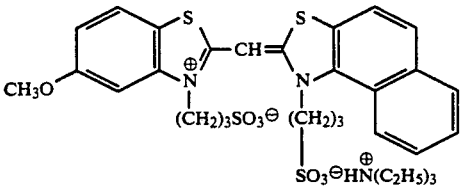
S-6
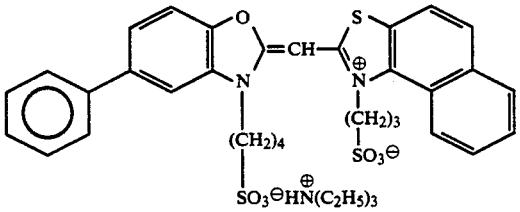
S-7
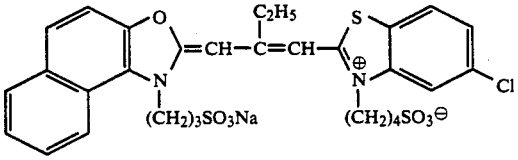
S-8
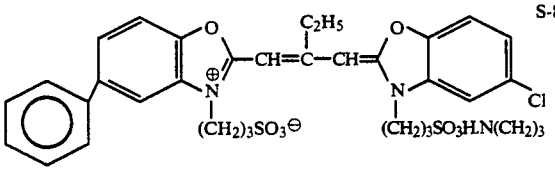
D-1
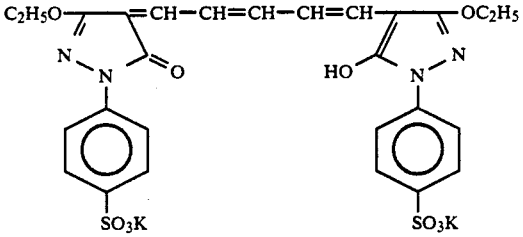
D-2
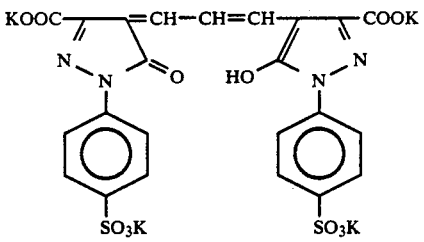
D-3
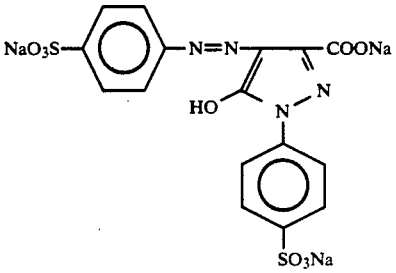

-continued

D-4

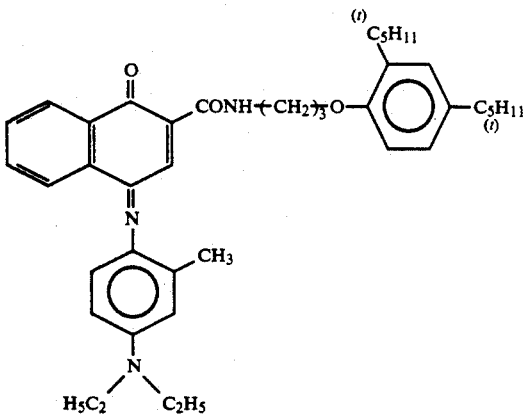

H-1

$CH_2{=}CHSO_2CH_2CONHCH_2$
$CH_2{=}CHSO_2CH_2CONHCH_2$

W-1

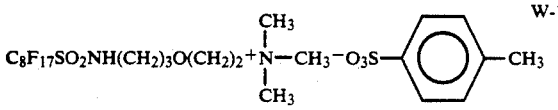

W-2

$C_8F_{17}SO_2N(C_3H_7)CH_2COOK$

W-3

$NaO_3S{-}CH(CH_2COOCH_2CH(C_2H_5)C_4H_9)COOCH_2CH(C_2H_5)C_4H_9$

W-4

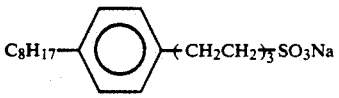

P-1

$\leftarrow CH_2CH \rightarrow$ ($CONHC_4H_9$ (t))

M-1

$\leftarrow CH_2CH \rightarrow$ ($COOC_4H_9$)

F-1

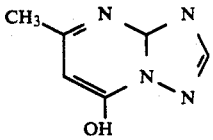

F-2

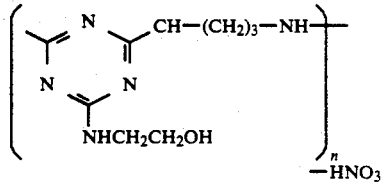

F-3

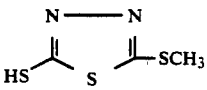

-continued

F-4

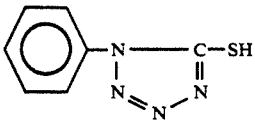

F-5

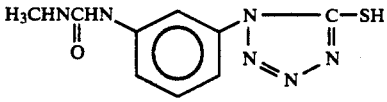

F-6

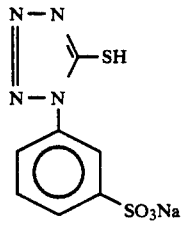

F-7

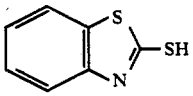

Preparation of Sample 202

Sample 202 was prepared in the same manner as Sample 201, except that Emulsions B, E, F, G, H, I and K were replaced by those having the same grain size, the same variation coefficient and the same AgI content but being chemically sensitized only on the surfaces of the grains.

Preparation of Samples 203 and 204

Samples 203 and 204 were prepared in the same manner as Samples 201 and 202, respectively, except that Emulsions I, H, G, F and E were replaced by those prepared by adding $10^{-5}$ mol per mol of silver halide of aqueous $Na_2[PdCl_4]$ solution at the point in time when 20% of formation of emulsion grains had finished. The content of Pd in each sample was $2.9\times10^{-6}$ mol per mol of total silver.

Preparation of Samples 205 to 207

Sample 205 was prepared in the same manner as Sample 201 except that $Na_2[PdCl_4]$ was added to the high-sensitivity green-sensitive emulsion layer in an amount of $2.9\times10^{-6}$ mol per mol of the silver halide in the layer; Sample 206 was prepared also in the same manner except that the compound was added to the low-sensitivity green-sensitive emulsion layer in the same amount; and Sample 207 was prepared also in the same manner except that the compound was added to the twelfth interlayer in the same amount.

The thus prepared silver halide color photographic materials were exposed and then developed by an automatic developing machine in accordance with the process mentioned below, whereupon the process was continued until the cumulative amount of the replenisher added was three times the tank capacity.

| Step | Time | Temp. | Tank Capacity | Amount of Replenisher |
|---|---|---|---|---|
| First Development | 6 min. | 38° C. | 12 l | 2200 ml/m² |

-continued

| Step | Time | Temp. | Tank Capacity | Amount of Replenisher |
|---|---|---|---|---|
| First Rinsing | 45 sec. | 38° C. | 2 l | 2200 ml/m$^2$ |
| Reversal | 45 sec. | 38° C. | 2 l | 1100 ml/m$^2$ |
| Color Development | 6 min. | 38° C. | 12 l | 2200 ml/m$^2$ |
| Bleaching | 2 min. | 38° C. | 4 l | 860 ml/m$^2$ |
| Bleach-fixation | 4 min. | 38° C. | 8 l | 1100 ml/m$^2$ |
| Second Rinsing (1) | 1 min. | 38° C. | 2 l | — |
| Second Rinsing (2) | 1 min. | 38° C. | 2 l | 1100 ml/m$^2$ |
| Stabilization | 1 min. | 25° C. | 2 l | 1100 ml/m$^2$ |

-continued

| Step | Time | Temp. | Tank Capacity | Amount of Replenisher |
|---|---|---|---|---|
| Drying | 1 min. | 65° C. | — | — |

In the process, replenishment to the second rinsing step was effected by a so-called countercurrent replenishment system wherein a fresh replenisher was introduced into the second rinsing tank (2) and the resulting overflow from the second rinsing tank (2) was returned back to the first rinsing tank (1).

The processing solutions used in the process had the following compositions.

| First Developer: | Mother Solution | Replenisher |
|---|---|---|
| Pentasodium Nitrilo-N,N,N-trimethylenephosphonate | 2.0 g | 2.0 g |
| Sodium Sulfite | 30 g | 30 g |
| Hydroquinone/Potassium monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 1.4 g |
| Potassium Thiocyanate | 1.2 g | 1.2 g |
| Potassium Iodide | 2.0 mg | — |
| Water to make | 1000 ml | 1000 ml |
| pH (adjusted with HCl or KOH) | 9.60 | 9.60 |

| First Rinsing Solution: | Mother solution and replenisher were same. |
|---|---|
| Ethylenediaminetetramethylenephosphonic Acid | 2.0 g |
| Disodium Phosphate | 5.0 g |
| Water to make | 1000 ml |
| pH (adjusted with HCl or KOH) | 7.00 |

| Reversal Processing Solution: | |
|---|---|
| Pentasodium Nitrilo-N,N,N-trimethylenephosphonate | 3.0 g |
| Stannous Chloride Dihydrate | 1.0 g |
| P-aminophenol | 0.1 g |
| Sodium Hydroxide | 8 g |
| Glacial Acetic Acid | 15 ml |
| Water to make | 1000 ml |
| pH (adjusted with HCl or NaOH) | 6.00 |

| Color Developer: | Mother Solution | Replenisher |
|---|---|---|
| Pentasodium Nitrilo-N,N,N-trimethylene-phosponate | 2.0 g | 2.0 g |
| Sodium Sulfite | 7.0 g | 7.0 g |
| Trisodium Phosphate 12-Hydrate | 36 g | 36 g |
| Potassium Bromide | 1.0 | — |
| Potassium Iodide | 90 mg | — |
| Sodium Hydroxide | 3.0 g | 3.0 g |
| Citrazinic Acid | 1.5 g | 1.5 g |
| N-ethyl-N-(β-methanesulfonamidoethyl)-3-methyl-4-aminoaniline Sulfate | 11 g | 11 g |
| 3,6-Dithiaoctane-1,8-diol | 1.0 g | 1.0 g |
| Water to make | 1000 ml | 1000 ml |
| pH (adjusted with HCl or KOH) | 11.80 | 12.00 |

| Bleaching Solution: | Mother solution and replenisher were same. |
|---|---|
| Disodium Ethylenediaminetetraacetate Dihydrate | 10.0 g |
| Amonium Ethylenediaminetetraacetato/Fe(III) Dihydrate | 120 g |
| Ammonium Bromide | 100 g |
| Ammonium Nitrate | 10 g |
| Bleaching Accelerator | 0.005 mol |

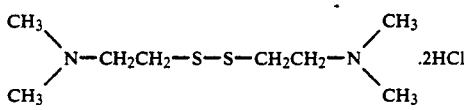

| | |
|---|---|
| Water to make | 1000 ml |

-continued

| | |
|---|---|
| pH (adjusted with HCl or aqueous ammonia) | 6.30 |
| Bleach-fixing Solution: | |
| Ammonium Ethylenediaminetetra-acetato/Fe(III) Dihydrate | 50 g |
| Disodium Ethylenediaminetetraacetate Dihydrate | 5.0 g |
| Ammonium Thiosulfate | 80 g |
| Sodium Sulfite | 12.0 g |
| Water to make | 1000 ml |
| pH (adjusted with HCl or aqueous ammonia) | 6.60 |

Tap water was passed through a mixed bed type column filled with an H-type strong acidic cation-exchange resin (Amberlite IR-120B, produced by Rhom & Haas Co.) and an OH-type anion-exchange resin (Amberlite IRA-400, produced by Rhom & Haas Co.) so that both the calcium ion concentration and the magnesium ion concentration in the water were reduced to 3 mg/liter or lower than 3 mg/liter, individually. Next, 20 ml/liter of sodium dichloroisocyanurate and 1.5 g/liter of sodium sulfate were added to the resulting water, which had a pH value falling within the range of from 6.5 to 7.5. This was used as the second rinsing water.

| Stabilizing Solution: Mother solution and replenisher were same. | |
|---|---|
| Formalin (37 wt/vol. %) | 5.0 ml |
| Polyoxyethylene-p-monononylphenyl Ether (mean polymerization degree 10) | 0.5 ml |
| Water to make | 1000 ml |
| pH (not adjusted) | |

The sensitivity ($S_{0.5}$) was obtained from the amount of exposure giving a magenta density of (minimum density+0.5) and is shown in Table 2-3 below along with the magenta maximum density ($D_{max}$). Each sample was stored under the conditions of 50° C. and a relative humidity of 50% for 3 days and then exposed and processed in the same manner. The variation ($\Delta D_{max}$) of the maximum density ($D_{max}$) between the aged sample and the fresh sample was obtained and is also shown in Table 2-3 below.

From the results shown in Table 2-3, it is understood that Sample 203 prepared by adding Pd during formation of the emulsion grains had a higher Dmax and a higher $S_{0.5}$, but had a smaller $\Delta D_{max}$ than Sample 201. Additionally, it is also understood therefrom that the sensitivity-elevating effect was far greater in the case of adding Pd during formation of the emulsion grains (Sample 203) than the case where Pd was added to the emulsion containing grains as chemical-sensitized on the surfaces thereof and that the degree of elevation of the sensitivity was extremely high. Regarding the effect caused by addition of Pd, it is preferred that Pd is added to the light-sensitive emulsion-containing layer (Sample 206), rather than to the light-sensitive emulsion-free layer (Sample 207). More preferably, Pd is added to the high-sensitivity emulsion-containing layer (Sample 205). It is further understood that addition of the same amount of Pd to the emulsion during formation of emulsion grains is preferred (Sample 203).

TABLE 2-3

| Sample | Remarks | $S_{0.5}$ | $D_{MAX}$ | $\Delta D_{MAX}$ |
|---|---|---|---|---|
| 201 | Comparative sample | 0 | 3.40 | 0.10 |

TABLE 2-3-continued

| Sample | Remarks | $S_{0.5}$ | $D_{MAX}$ | $\Delta D_{MAX}$ |
|---|---|---|---|---|
| 202 | " | −0.20 | 3.52 | 0.15 |
| 203 | Sample of the invention | +0.12 | 3.65 | 0.04 |
| 204 | Comparative sample | −0.12 | 3.58 | 0.11 |
| 205 | Sample of the invention | +0.08 | 3.56 | 0.06 |
| 206 | " | +0.06 | 3.52 | 0.08 |
| 207 | " | +0.03 | 3.45 | 0.09 |

EXAMPLE 3

Preparation of Sample 301

The several layers mentioned below were formed on a cellulose triacetate film support having a subbing layer, to form a multi-layer color photographic material sample (Sample No. 301).

Compositions of Light-Sensitive Layers

The numbers corresponding to the respective components mentioned below indicate the amounts coated, which are represented by the unit of g/m². For silver halides and colloidal silvers, the number indicates the amount of silver therein. For couplers, additives and gelatin, the number indicates the amount thereof coated. For sensitizing dyes, the amount coated is represented by the unit of mols per mol of the silver halide in the same layer. The meaning of the symbols indicating the respective additives are mentioned below. Where one additive substance has several functions or actions, a typical function is mentioned.

UV: Ultraviolet Absorbent
Solv: High Boiling Point Organic Solvent
ExF: Dye
ExS: Sensitizing Dye
ExC: Cyan Coupler
ExM: Magenta Coupler
ExY: Yellow Coupler
Cpd: Additive

| | |
|---|---|
| First Layer (Anti-Halation Layer): | |
| Black Colloidal Silver | 0.15 |
| Gelatin | 2.0 |
| ExM-6 | 0.2 |
| UV-1 | 0.03 |
| UV-2 | 0.06 |
| UV-3 | 0.07 |
| Solv-1 | 0.3 |
| Solv-2 | 0.08 |
| ExF-1 | 0.01 |
| ExF-2 | 0.01 |
| ExF-3 | 0.005 |
| Cpd-6 | 0.001 |
| Second Layer (Low-Sensitivity Red-Sensitive Emulsion Layer): | |
| Silver Iodobromide Emulsion (AgI 4.0 mol %; uniform AgI type | 0.37 as Ag |

-continued

| | |
|---|---|
| grains; sphere-corresponding diameter 0.4 μm; variation coefficient of sphere-corresponding diameter 30%; tabular grains having an aspect ratio of diameter/thickness of being 3.0) | |
| Silver Iodobromide Emulsion (AgI 6.0 mol %; AgI-rich core-type grains with core/shell ratio of 2/1; sphere-corresponding diameter 0.45 μm; variation coefficient of sphere-corresponding diameter 23%; tabular grains having an aspect ratio of diameter/thickness of 2.0) | 0.19 as Ag |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.17 |
| ExC-2 | 0.03 |
| ExC-3 | 0.009 |
| Third Layer (Middle-Sensitivity Red-Sensitive Emulsion Layer): | |
| Silver Iodobromide Emulsion (AgI 6.0 mol %; AgI-rich core-type grains with core/shell ratio of 2/1; sphere-corresponding diameter 0.65 μm; variation coefficient of sphere-corresponding diameter 23%; tabular grains having an aspect ratio of diameter/thickness of 2.0) | 0.65 as Ag |
| Gelatin | 1.0 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.31 |
| ExC-2 | 0.01 |
| ExC-3 | 0.10 |
| Fourth Layer (High-Sensitivity Red-Sensitive Emulsion Layer): | |
| Silver Iodobromide Emulsion (AgI 9.3 mol %; multi-layer structure grains with Ag amount ratio of 3/4/2, having proportion of AgI content of 24/0/6 (innermost core/middle layer/outermost shell) by mol %; sphere corresponding diameter 0.75 μm; variation coefficient of sphere-corresponding diameter 23%; tabular grains having an aspect ratio of diameter/thickness of 2.5) | 1.5 as Ag |
| Gelatin | 1.4 |
| ExS-1 | $1.9 \times 10^{-4}$ |
| ExS-2 | $1.2 \times 10^{-4}$ |
| ExS-5 | $1.9 \times 10^{-4}$ |
| ExS-7 | $8.0 \times 10^{-6}$ |
| ExC-1 | 0.08 |
| ExC-4 | 0.09 |
| Solv-1 | 0.08 |
| Solv-2 | 0.20 |
| Cpd-7 | $4.6 \times 10^{-4}$ |
| Fifth Layer (Interlayer): | |
| Gelatin | 0.6 |
| Cpd-1 | 0.1 |
| Polyethyl Acrylate Latex | 0.08 |
| Solv-1 | 0.08 |
| Sixth Layer (Low-Sensitivity Green-Sensitive Emulsion Layer: | |
| Silver Iodobromide Emulsion (AgI 4.0 mol %; uniform AgI type grains; sphere-corresponding diameter 0.33 μm; variation coefficient of sphere-corresponding diameter 37%; tabular grains having an aspect ratio of diameter/thickness of 2.0) | 0.18 as Ag |
| Gelatin | 0.4 |
| ExS-3 | $1.6 \times 10^{-4}$ |
| ExS-4 | $4.8 \times 10^{-4}$ |
| ExS-5 | $1 \times 10^{-4}$ |
| ExM-5 | 0.16 |

-continued

| | |
|---|---|
| ExM-7 | 0.03 |
| ExY-8 | 0.01 |
| Solv-1 | 0.06 |
| Solv-4 | 0.01 |
| Seventh Layer (Middle-Sensitivity Green-Sensitive Emulsion Layer): | |
| Silver Iodobromide Emulsion (AgI 4.0 mol %; uniform AgI type grains; sphere-corresponding diameter 0.55 μm; variation coefficient of sphere-corresponding diameter 15%; tabular grains having an aspect ratio of diameter/thickness of 4.0) | 0.27 as Ag |
| Gelatin | 0.6 |
| ExS-3 | $2 \times 10^{-4}$ |
| ExS-4 | $7 \times 10^{-4}$ |
| ExS-5 | $1.4 \times 10^{-4}$ |
| ExM-5 | 0.17 |
| ExM-7 | 0.04 |
| ExY-8 | 0.04 |
| Solv-1 | 0.14 |
| Solv-4 | 0.01 |
| Eighth Layer (High-Sensitivity Green-Sensitive Emulsion Layer): | |
| Silver Iodobromide Emulsion (AgI 8.8 mol %; multi-layer structure grains with Ag amount ratio of 3/4/2, having proportion of AgI content of 24/0/3 (innermost core/middle layer/outermost shell) by mol %; sphere-corresponding diameter 0.75 μm; variation coefficient of sphere-corresponding diameter 23%; tabular grains having an aspect ratio of diameter/thickness of 1.6) | 0.5 as Ag |
| Gelatin | 0.6 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.08 |
| ExM-6 | 0.03 |
| ExY-8 | 0.02 |
| ExC-1 | 0.01 |
| ExC-4 | 0.01 |
| Solv-1 | 0.23 |
| Solv-2 | 0.05 |
| Solv-4 | 0.01 |
| Cpd-7 | $1 \times 10^{-4}$ |
| Cpd-8 | 0.01 |
| Ninth Layer (Interlayer): | |
| Gelatin | 0.6 |
| Cpd-1 | 0.04 |
| Polyethyl Acrylate Latex | 0.05 |
| Solv-1 | 0.02 |
| UV-4 | 0.03 |
| UV-5 | 0.04 |
| Tenth Layer (Interlayer Effect-Donating Layer to Red-Sensitive Layer): | |
| Silver Iodobromide Emulsion (AgI 8.0 mol %; AgI-rich core-type grains with core/shell ratio of 2/1; sphere-corresponding diameter 0.65 μm; variation coefficient of sphere-corresponding diameter 25%; tabular grains having an aspect ratio of diameter/thickness of 2.0) | 0.72 as Ag |
| Silver Iodobromide Emulsion (AgI 4.0 mol %; uniform AgI-type grains; sphere-corresponding diameter 0.4 μm; variation coefficient of sphere-corresponding diameter 30%; tabular grains having an aspect ratio of diameter/thickness of 3.0) | 0.21 as Ag |
| Gelatin | 1.0 |
| ExS-3 | $6 \times 10^{-4}$ |
| ExM-10 | 0.19 |
| Solv-1 | 0.30 |
| Solv-6 | 0.03 |
| Eleventh Layer (Yellow Filter Layer): | |
| Yellow Colloidal Silver | 0.06 |
| Gelatin | 0.8 |

-continued

| | |
|---|---|
| Cpd-2 | 0.13 |
| Solv-1 | 0.13 |
| Cpd-1 | 0.07 |
| Cpd-6 | 0.002 |
| H-1 | 0.13 |
| Twelfth Layer (Low-Sensitivity Blue-Sensitive Emulsion Layer): | |
| Silver Iodobromide Emulsion (AgI 4.5 mol %; uniform AgI-type grains; sphere-corresponding diameter 0.7 μm; variation coefficient of sphere-corresponding diameter 15%; tabular grains having an aspect ratio of diameter/thickness of 7.0) | 0.45 as Ag |
| Silver Iodobromide Emulsion (AgI 3.0 mol %; uniform AgI-type grains; sphere-corresponding diameter 0.3 μm; variation coefficient of sphere-corresponding diameter 30%; tabular grains having an aspect ratio of diameter/thickness of 7.0) | 0.25 as Ag |
| Gelatin | 2.1 |
| ExS-6 | $9.0 \times 10^{-4}$ |
| ExC-1 | 0.13 |
| ExC-4 | 0.03 |
| ExY-9 | 0.16 |
| ExY-11 | 1.04 |
| Solv-1 | 0.51 |
| Thirteenth Layer (Interlayer): | |
| Gelatin | 0.40 |
| ExY-12 | 0.20 |
| Solv-1 | 0.19 |
| Fourteenth Layer (High-Sensitivity Blue-Sensitive Emulsion Layer): | |
| Silver Iodobromide Emulsion (AgI 10.0 mol %; AgI-rich core-type grains; sphere-corresponding diameter 1.0 μm; variation coefficient of sphere-corresponding diameter 25%; multi-layer twin tabular grains having an aspect ratio of diameter/thickness of 2.0) | 0.4 as Ag |
| Gelatin | 0.5 |
| ExS-6 | $1 \times 10^{-4}$ |
| ExY-9 | 0.01 |
| ExY-11 | 0.20 |
| ExC-1 | 0.01 |
| Solv-1 | 0.10 |
| Fifteenth Layer (First Protective Layer): | |
| Fine Silver Iodobromide Grain Emulsion (AgI 2 mol %; uniform AgI-type grains; sphere-corresponding diameter 0.07 μm) | 0.12 as Ag |
| Gelatin | 0.7 |
| UV-4 | 0.11 |
| UV-5 | 0.16 |
| Solv-5 | 0.02 |
| H-1 | 0.13 |
| Cpd-5 | 0.10 |
| Polyethyl Acrylate Latex | 0.09 |
| Sixteenth Layer (Second Protective Layer): | |
| Fine Silver Iodobromide Grain Emulsion (AgI 2 mol %; uniform AgI-type grains; sphere-corresponding diameter 0.07 μm) | 0.36 as Ag |
| Gelatin | 0.85 |
| Polymethyl Methacrylate Grains (diameter 1.5 μm) | 0.2 |
| Cpd-4 | 0.04 |
| W-4 | 0.02 |
| H-1 | 0.17 |

The sample thus prepared further contained, in addition to the above-mentioned components, CpD-3 (emulsion stabilizer) (0.07 g/m$^2$), W-1 (Surfactant) (0.006 g/m$^2$), W-2 (Surfactant) (0.33 g/m$^2$) and W-3 (Surfactant) (0.10 g/m$^2$) as coating aids and emulsifying and dispersing aids in each layer.

Compounds used in preparing the sample are shown below.

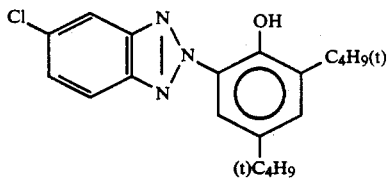

UV-1

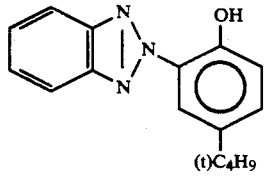

UV-2

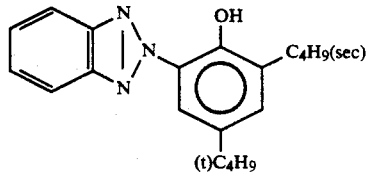

UV-3

-continued
UV-4
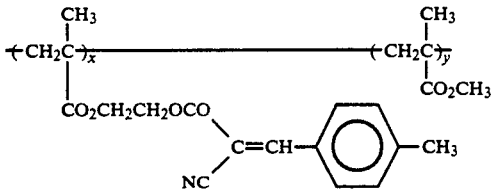
x:y = 70:30 (wt %)
UV-5
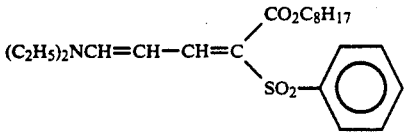
Tricresyl phosphate — Solv-1
Dibutyl phthalate — Solv-2
Solv-4
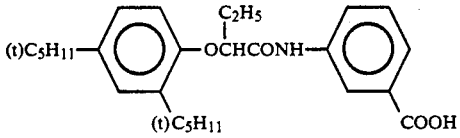
Trihexyl Phosphate — Solv-5
Solv-6
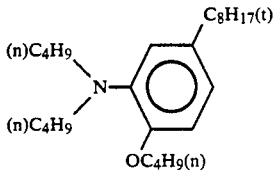
ExF-1
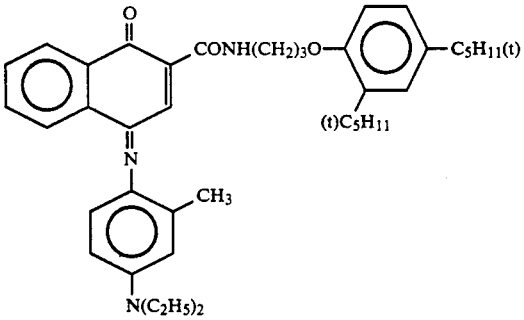
ExF-2
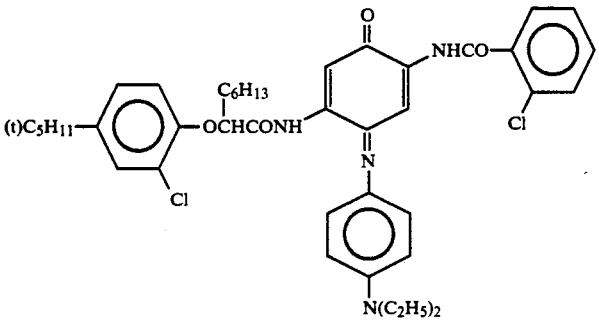

-continued
ExF-3
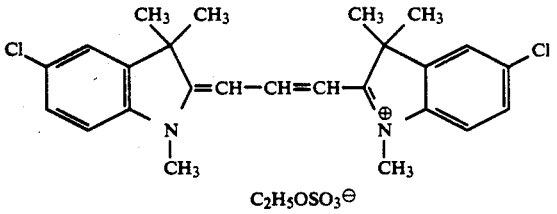
ExS-1
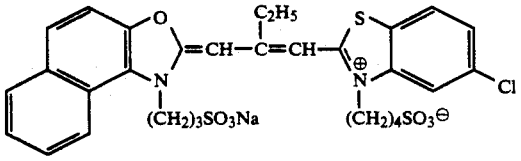
ExS-2
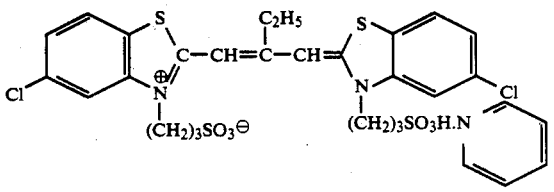
ExS-3
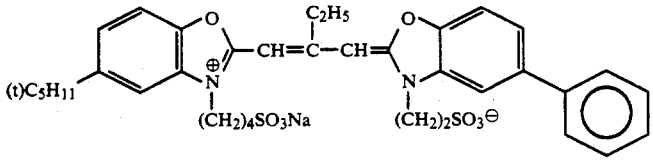
ExS-4
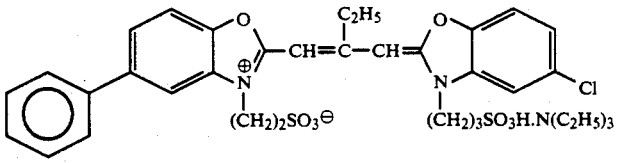
ExS-5
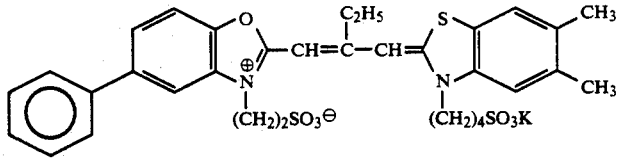
ExS-6
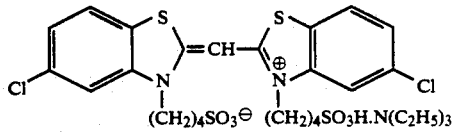
ExS-7
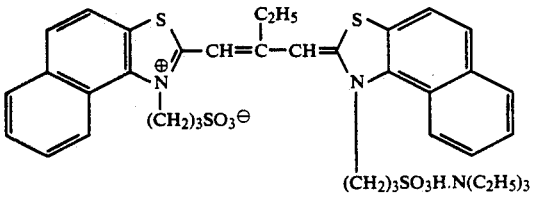

-continued
ExS-8
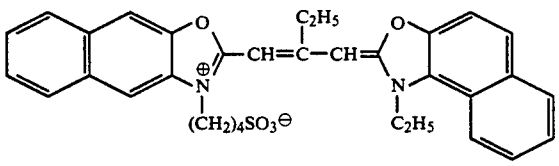
ExC-1
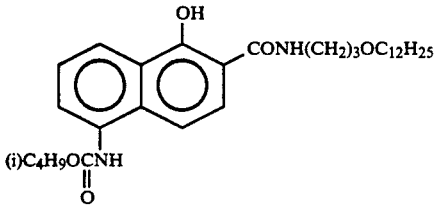
ExC-2
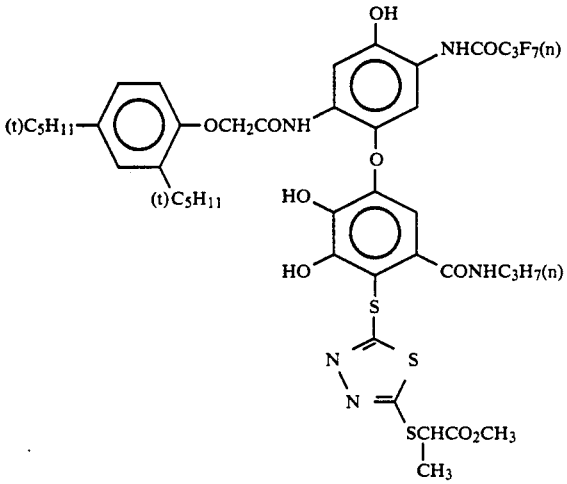
ExC-3
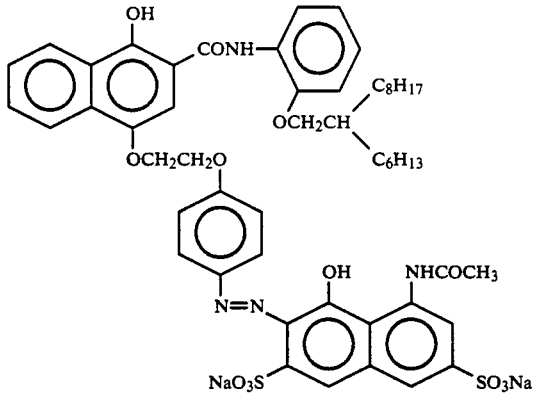
ExC-4
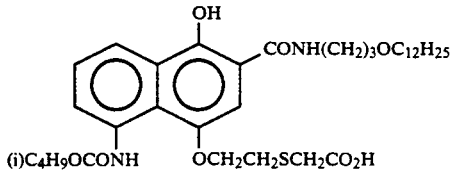

-continued
ExM-5
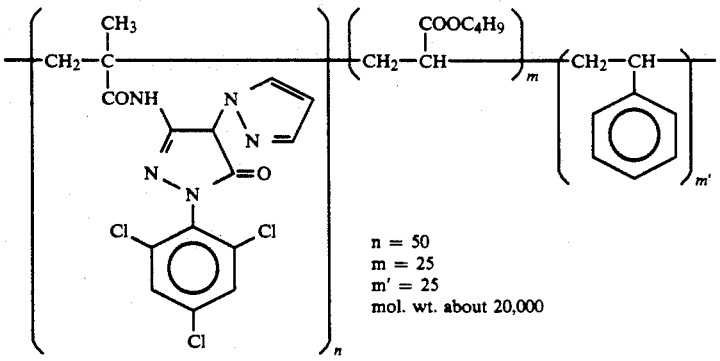
ExM-6
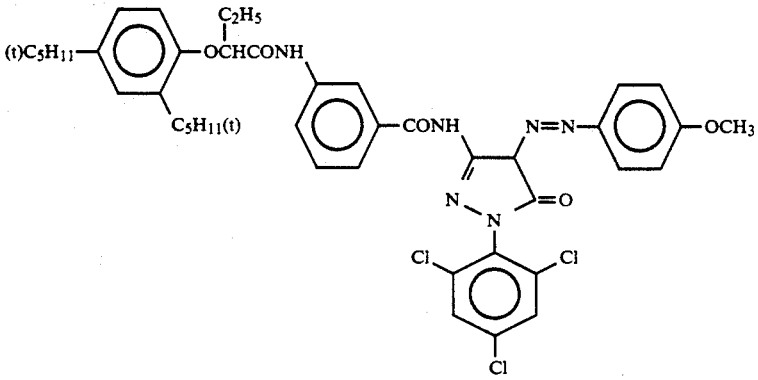
ExM-7
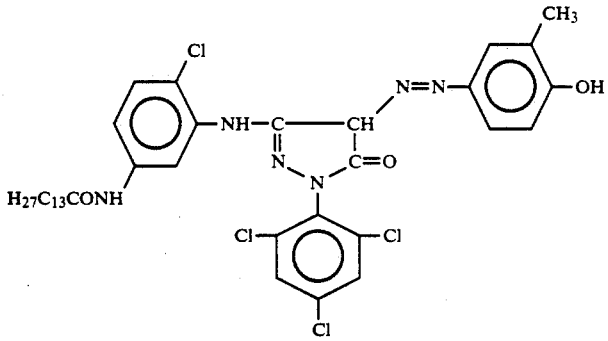
ExM-10
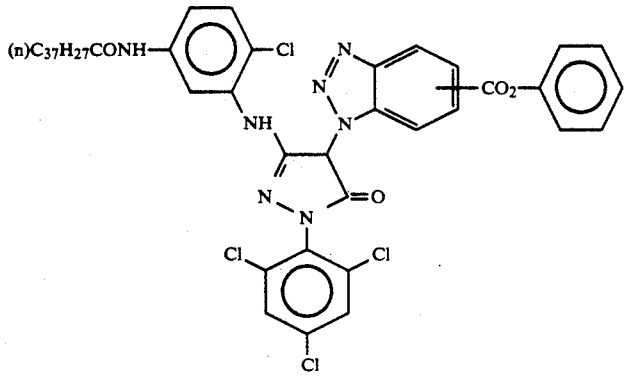

-continued
ExY-8
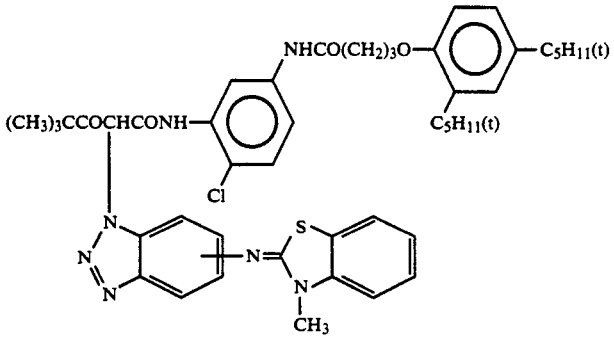
ExY-9
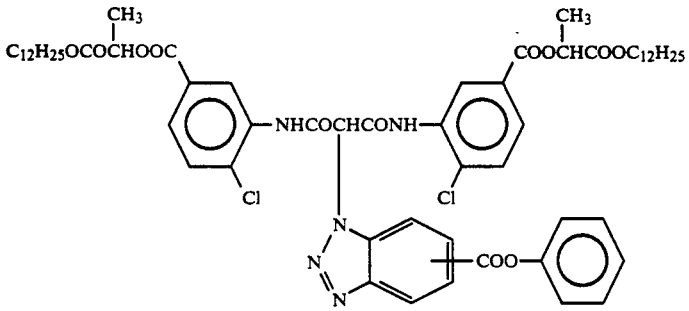
ExY-11
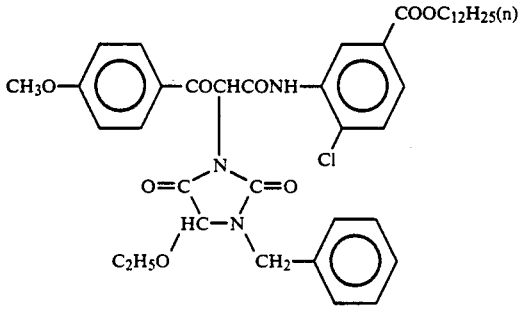
ExY-12
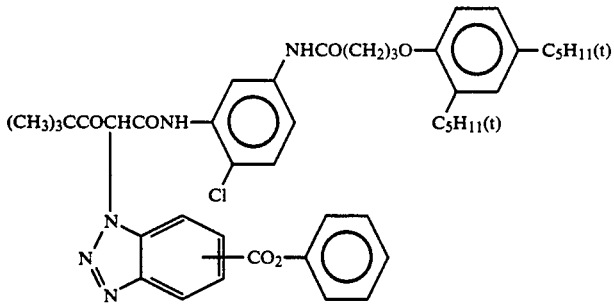
Cpd-1
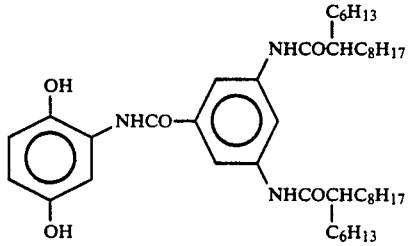

-continued
Cpd-2
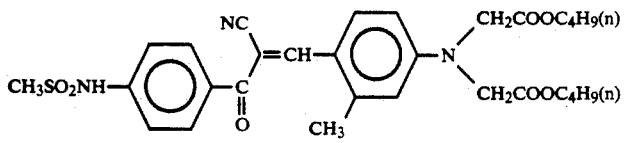
Cpd-3
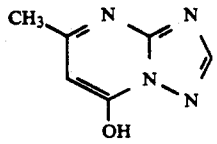
Cpd-4
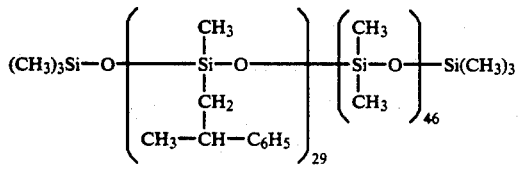
Cpd-5
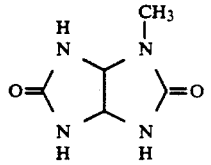
Cpd-6
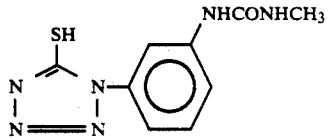
Cpd-7
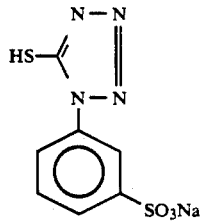
Cpd-8
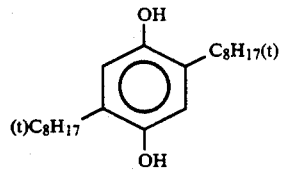
H-1
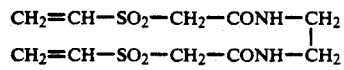
W-1
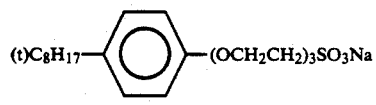
W-2
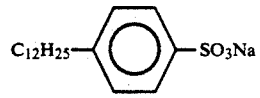

-continued

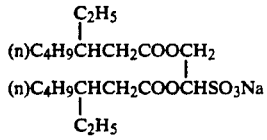

W-3

$C_8F_{17}SO_2N(C_3H_7)CH_2COOK$

W-4

Preparation of Sample 302

Sample 302 was prepared in the same manner as Sample 301, except that the silver iodobromide emulsion in the middle-sensitivity red-sensitive emulsion layer was replaced by an internal latent image type emulsion wherein the grains had been chemical-sensitized at the depth of 0.003 micrometer from the surface of the grain.

Preparation of Samples 303 and 304

Samples 303 and 304 were prepared in the same manner as Samples 301 and 302, respectively, except that $3\times10^{-6}$ mol per mol of silver halide of $Na_2[PdCl_4]$ was added to the silver iodobromide emulsion of the middle-sensitivity red-sensitive emulsion layer at the point in time when 80% of the grains in the emulsion were formed.

Each of the thus prepared samples was uniformly exposed to a white light of 4800° K for 1/100 second and then processed in accordance with the process mentioned below.

Processing Steps:

| Step | Temp. | Time | Amount of Replenisher (*) | Tank Capacity |
|---|---|---|---|---|
| Color Development | 37.8° C. | 3 min 15 sec | 21 | 5 l |
| Bleaching | 38.0° C. | 45 sec | 45 | 2 l |
| Fixation (1) | 38.0° C. | 45 sec | two-tank counter-current system | 2 l |
| Fixation (2) | 38.0° C. | 45 sec | 30 | 2 l |
| Stabilization (1) | 38.0° C. | 20 sec | three-tank counter-current system | 1 l |
| Stabilization (2) | 38.0° C. | 20 sec | | 1 l |
| Stabilization (3) | 38.0° C. | 20 sec | 35 | 1 l |
| Drying | 55° C. | 1 min 00 sec | | |

(*) Amount of replenisher: per meter of 35 mm-wide sample being processed.

The fixation tank of the automatic developer used for effecting the development process was equipped with a jet stream stirring means (described in JP-A-62-183460, page 3) whereby a jet stream of the fixing solution was run to the emulsion-coated surface of the sample during fixation.

Processing solutions used in the development process had the following compositions.

| | Mother Solution (g) | Replenisher (g) |
|---|---|---|
| Color Developer: | | |
| Hydroxyethyliminodiacetic Acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-[N-ethyl-N-β-hydroxyethyl-amino]-2-methylaniline Sulfate | $1.0\times10^{-2}$ mol | $1.3\times10^{-2}$ mol |
| Water to make | 1.0 l | 1.0 l |
| pH | 10.00 | 10.15 |
| Bleaching Solution: | | |
| 1,3-Diaminopropanetetraacetato/ferric Complex | 130 | 190 |
| 1,3-Diaminopropanetetraacetic Acid | 3.0 | 4.0 |
| Ammonium Bromide | 85 | 120 |
| Acetic Acid | 50 | 70 |
| Ammonium Nitrate | 30 | 40 |
| Water of make | 1.0 l | 1.0 l |
| pH (adjusted with acetic acid and aqueous ammonia) | 4.3 | 3.5 |
| Fixing Solution: | | |
| 1-Hydroxyethylidene-1,1-di-phosphonic Acid | 5.0 | 7.0 |
| Disodium Ethylenediaminetetra-acetate | 0.5 | 0.7 |
| Sodium Sulfite | 10.0 | 12.0 |
| Sodium Bisulfite | 8.0 | 10.0 |
| Ammonium Thiosulfate (aqueous solution, 700 g/liter) | 170.0 ml | 200.0 ml |
| Ammonium Thiocyanate | 100.0 | 150.0 |
| Thiourea | 3.0 | 5.0 |
| 3,6-Dithia-1,8-octanediol | 3.0 | 5.0 |
| Water to make | 1.0 l | 1.0 l |
| pH (adjusted with ammonium acetate) | 6.5 | 6.7 |
| Stabilizing Solution: | Mother solution and replenisher were same. | |
| Formalin (37 vol./wt %) | 1.2 ml | |
| 5-Chloro-2-methyl-4-isothiazolin-3-one | 6.0 mg | |
| 2-Methyl-4-isothiazolin-3-one | 3.0 mg | |
| Surfactant | 0.4 | |

-continued

| | |
|---|---|
| $[C_{10}H_{21}—O—(CH_2CH_2O)_{10}—H]$ | |
| Ethylene Glycol | 1.0 |
| Water to make | 1.0 liter |
| pH | 5.0 to 7.0 |

From the results obtained, it was understood that the fog of the red-sensitive layer in Sample 304, which contained an internal latent image type emulsion prepared by adding Pd during formation of the emulsion grains, was low and the sensitivity thereof was high.

Example 4

The following first to twelfth layers were coated on a paper support, both surfaces of which had been laminated with a polyethylene coat, to prepare a color photographic material sample. The polyethylene coat below the first layer contained titanium white as a white pigment and a slight amount of ultramarine as a bluish dye.

Composition of Light-Sensitive Layers

Components of constituting the respective layers are mentioned below along with the amounts thereof coated (as a unit of $g/m^2$). The amount of silver halide coated is represented by the amount of silver therein.

| | |
|---|---|
| First Layer: Gelatin Layer | |
| Gelatine | 1.30 |
| Second Layer: Anti-halation Layer | |
| Black Colloidal Silver | 0.10 |
| Gelatin | 0.70 |
| Third Layer: Low-sensitivity Red-sensitive Layer | |
| Silver Chloroiodobromide Emulsion EM1 color-sensitized with red-sensitizing dyes (ExS-1, 2, 3) (silver chloride content 1 mol %; silver iodide content 4 mol %; mean grain size 0.3 micron, size distribution 10%, cubic core-iodine core/shell grains) | 0.06 |
| Silver Iodobromide Emulsion EM2 color-sensitized with red-sensitizing dyes (ExS-1, 2, 3) (silver iodide content 5 mol %; mean grain size 0.45 micron; size distribution 20%; tabular grains with aspect ratio of 5) | 0.10 |
| Gelatin | 1.00 |
| Cyan Coupler (ExC-1) | 0.14 |
| Cyan Coupler (ExC-2) | 0.07 |
| Anti-fading Agent (1/1/1/1 (by weight) mixture of Cpd-2, 3, 4, 9) | 0.12 |
| Coupler Dispersing Medium (Cpd-5) | 0.03 |
| Coupler Solvent (Solv-1, 2, 3) | 0.06 |
| Fourth Layer: High-sensitivity Red-sensitive Emulsion | |
| Silver Iodobromide Emulsion EM3 color-sensitized with red-sensitizing dyes (ExS-1, 2, 3) (silver iodide content 6 mol %; mean grain size 0.75 micron; size distribution 25%, tabular core-iodine grains with aspect ratio of 8) | 0.15 |
| Gelatin | 1.00 |
| Cyan Coupler (ExC-1) | 0.20 |
| Cyan Coupler (ExC-2) | 0.10 |
| Anti-fading Agent (1/1/1/1 mixture of Cpd-2, 3, 4, 9) | 0.15 |
| Coupler Dispersing Medium (Cpd-5) | 0.03 |
| Coupler Solvent (Solv-1, 2, 3) | 0.10 |
| Fifth Layer: Interlayer | |
| Magenta Colloidal Silver | 0.02 |
| Gelatin | 1.00 |
| Color Mixing Preventing Agent (Cpd-6, 7) | 0.08 |
| Solvent for Color Mixing Preventing Agent (Solv-4, 5) | 0.16 |
| Polymer Latex (Cpd-8) | 0.10 |
| Sixth Layer: Low-sensitivity Green-sensitive Layer | |
| Silver Chloroiodobromide Emulsion EM4 color-sensitized with green-sensitizing dye (ExS-4) (silver iodide content 3.5 mol %; mean grain size 0.22 micron; cubic grains) | 0.04 |
| Silver Iodobromide Emulsion EM5 as color-sensitized with green-sensitizing dye (ExS-4) (silver iodide content 2.8 mol %; mean grain size 0.45 micron; grain size distribution 12%; tabular grains with aspect ratio of 5) | 0.06 |
| Gelatin | 0.80 |
| Magenta Coupler (ExM-1) | 0.10 |
| Anti-fading Agent (Cpd-9) | 0.10 |
| Stain Inhibitor (Cpd-10) | 0.01 |
| Stain Inhibitor (Cpd-11) | 0.001 |
| Stain Inhibitor (Cpd-12) | 0.01 |
| Coupler Dispersing Medium (Cpd-5) | 0.05 |
| Coupler Solvent (Solv-4, 6) | 0.15 |
| Seventh Layer: High-sensitivity Green-sensitive Emulsion | |
| Silver Iodobromide Emulsion EM6 color-sensitized with green-sensitizing dye (ExS-4) (silver iodide content 3.5 mol %; mean grain size 0.9 micron; grain size distribution 23%; tabular uniform iodine grains with aspect ratio of 9) | 0.10 |
| Gelatin | 0.80 |
| Magenta Coupler (ExM-1) | 0.10 |
| Anti-fading Agent (Cpd-9) | 0.10 |
| Stain Inhibitor (Cpd-10) | 0.01 |
| Stain Inhibitor (Cpd-11) | 0.001 |
| Stain Inhibitor (Cpd-12) | 0.01 |
| Coupler Dispersing Medium (Cpd-5) | 0.05 |
| Coupler Solvent (Solv-4, 6) | 0.15 |
| Eighth Layer: Yellow Filter Layer | |
| Yellow Colloidal Silver | 0.20 |
| Gelatin | 1.00 |
| Color Mixing Preventing Agent (Cpd-7) | 0.06 |
| Solvent for Color Mixing Preventing Agent (Solv-4, 5) | 0.15 |
| Polymer Latex (Cpd-8) | 0.10 |
| Ninth Layer: Low-sensitivity Blue-sensitive Layer | |
| Silver Chloroiodobromide Emulsion EM7 color-sensitized with blue-sensitizing dyes (ExS-5, 6) (silver chloride content 2 mol %; silver iodide content 2.5 mol %; mean grain size 0.35 micron; grain size distribution 8%; cubic core-iodine core/shell grains) | 0.07 |
| Silver Iodobromide Emulsion EM8 color-sensitized with blue-sensitizing dyes (ExS-5, 6) (silver iodide content 2.5 mol %; mean grain size 0.45 micron; grain size distribution 16%; tabular grains with aspect ratio of 6) | 0.10 |
| Gelatin | 0.50 |
| Yellow Coupler (ExY-1) | 0.20 |
| Stain Inhibitor (Cpd-11) | 0.001 |
| Anti-fading Agent (Cpd-6) | 0.10 |
| Coupler Dispersing Medium (Cpd-5) | 0.05 |
| Coupler Solvent (Solv-2) | 0.05 |
| Tenth Layer: High-sensitivity Blue-sensitive Layer | |
| Silver Iodobromide Emulsion EM9 color-sensitized with blue-sensitizing dyes (ExS-5, 6) (silver iodide content 2.5 mol %; mean grain size 1.2 microns; grain size distribution 21%; tabular grains with aspect ratio of 14) | 0.25 |
| Gelatin | 1.00 |

-continued

| | |
|---|---|
| Yellow Coupler (ExY-1) | 0.40 |
| Stain Inhibitor (Cpd-11) | 0.002 |
| Anti-fading Agent (Cpd-6) | 0.10 |
| Coupler Dispersing Medium (Cpd-5) | 0.15 |
| Coupler Solvent (Solv-2) | 0.10 |
| Eleventh Layer: Ultraviolet Absorbing Layer | |
| Gelatin | 1.50 |
| Ultraviolet Absorbent (Cpd-1, 3, 13) | 1.00 |
| Color Mixing Preventing Agent (Cpd-6, 14) | 0.06 |
| Dispersing Medium (Cpd-5) | 0.10 |
| Ultraviolet Absorbent Solvent (Solv-1, 2) | 0.15 |
| Anti-irradiation Dye (Cpd-15, 16) | 0.02 |
| Anti-irradiation Dye (Cpd-17, 18) | 0.02 |
| Twelfth Layer: Protective Layer | |
| Fine Silver Chlorobromide Grains (silver chloride content 97 mol %, grain size 0.2 micron) | 0.07 |
| Modified Poval | 0.02 |
| Gelatin | 1.50 |
| Gelatin Hardening Agent (H-1) | 0.17 |

In addition to the above-mentioned components, each layer contained Alkanol XC (product by DuPont) and sodium alkylbenzenesulfonate as an emulsifying and dispersing aid respectively and succinate and Magefac F-120 (product by Dai-Nippon Ink) as a coating aid. Further, the silver halide layers and colloidal silver-containing layers contained a stabilizer (Cpd-19, 20, 21). The compounds used herein for preparing the sample are mentioned below.

ExS-1

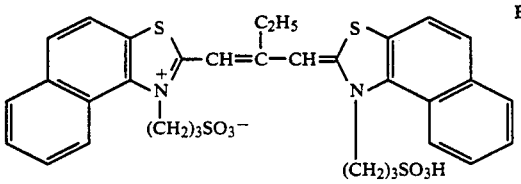

ExS-2

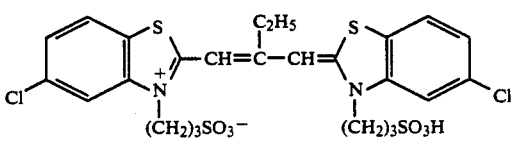

ExS-3

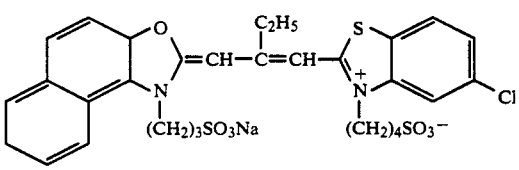

ExS-4

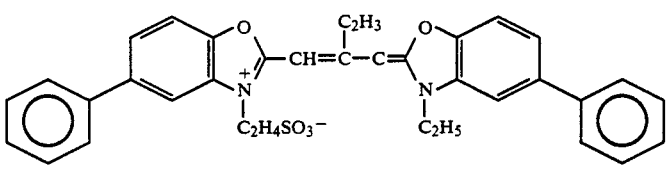

ExS-5

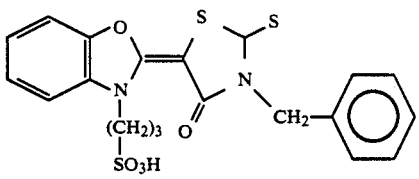

Cpd-1

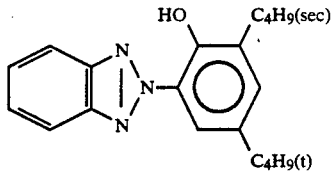

Cpd-2

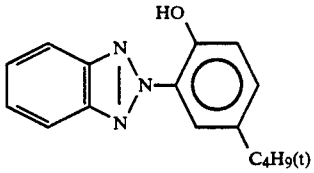

Cpd-3

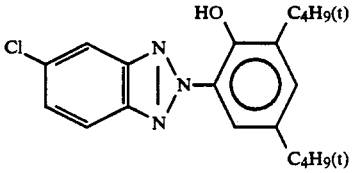

Cpd-4

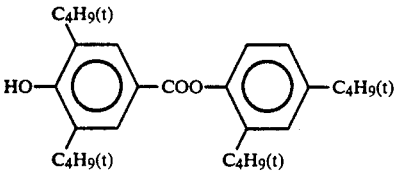

Cpd-5

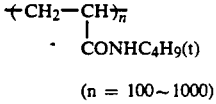

(n = 100~1000)

-continued
Cpd-6
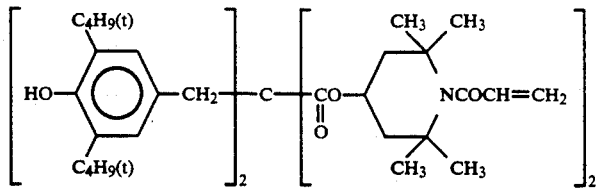
Cpd-7
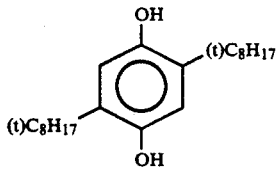
Polyethyl Acrylate
Cpd-8
Cpd-9
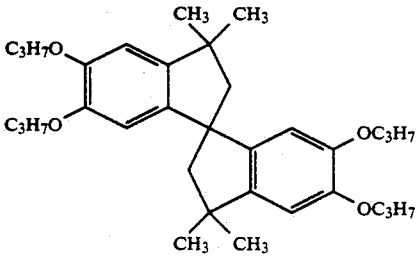
Cpd-10
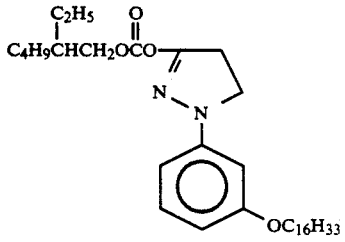
Cpd-11
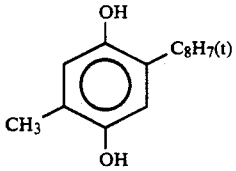
Cpd-12
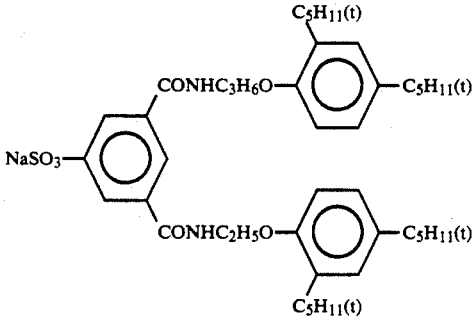
Cpd-13
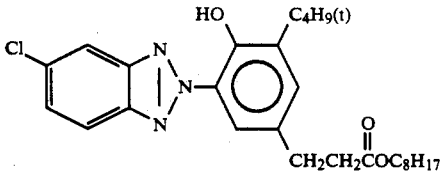
Cpd-14
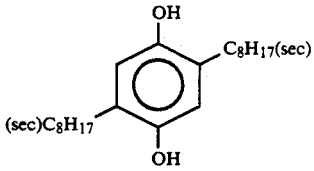
Cpd-15
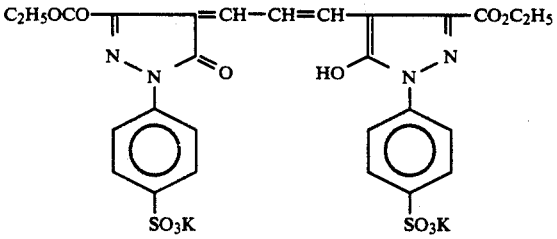
Cpd-16
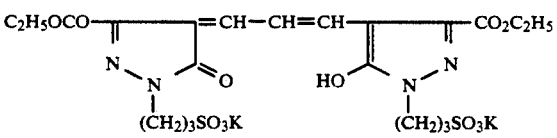

-continued
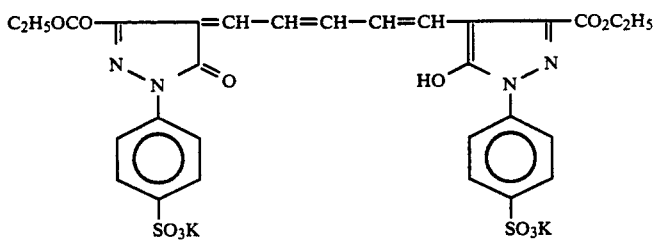
Cpd-17
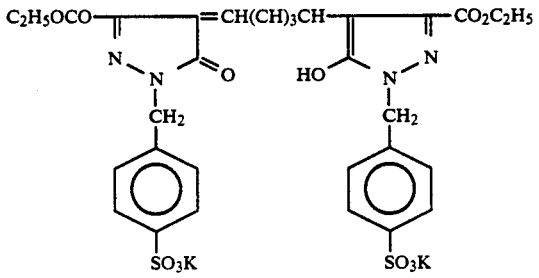
Cpd-18
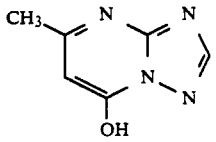
Cpd-19
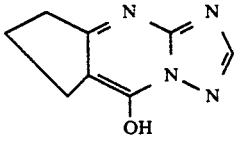
Cpd-20
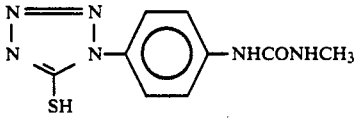
Cpd-21
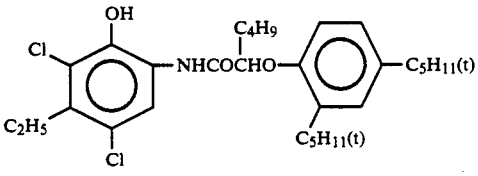
ExC-1
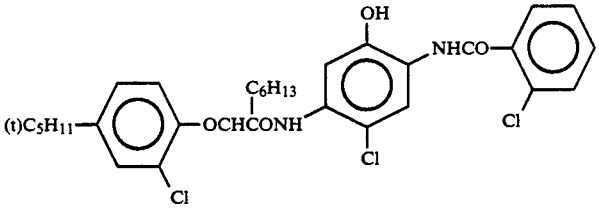
ExC-2
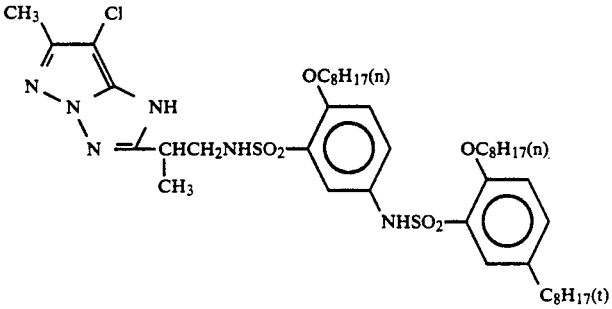
ExM-1

-continued

ExY-1

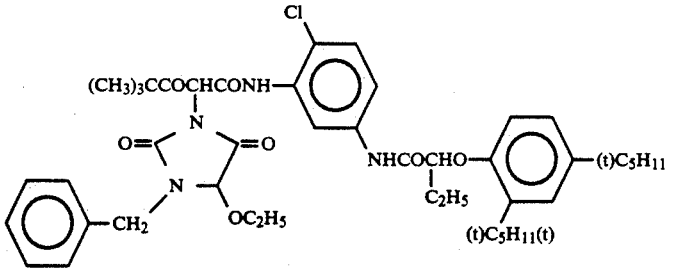

Solv - 1: Di(2-ethylhexyl) Phthalate
Solv - 2: Trinonyl Phosphate
Solv - 3: Di(3-methylhexyl) Phthalate
Solv - 4: Tricresyl Phosphate
Solv - 5: Dibutyl Phthalate
Solv - 6: Trioctyl Phosphate
Solv - 7: 1,2-Bis(vinylsulfonylacetamido)ethane Samples 401 to 414 were prepared in the same manner as mentioned above, except that the emulsion in the sixth layer (low-sensitivity green-sensitive layer) was replaced by Emulsions A to N in Example 1, respectively.

Each of the thus prepared samples was uniformly exposed to a white light of 4800° K for 1/100 second and then processed in accordance with the process mentioned below.

| Processing Steps: | Temp. | Time |
|---|---|---|
| First Development (black-and-white development | 38° C. | 45 sec |
| Rinsing in Water | 38° C. | 45 sec |
| Reversal Exposure | 500 lux or more | 15 sec or more |
| Color Development | 38° C. | 60 sec |
| Rinsing in Water | 38° C. | 15 sec |
| Bleach-fixation | 38° C. | 60 sec |
| Rinsing in Water | 38° C. | 60 sec |
| Drying | 38° C. | 60 sec |

Processing solutions used in the above-mentioned steps had the following compositions

| | |
|---|---|
| First Developer: | |
| Pentasodium Nitrilo-N,N,N-trimethylene phosphonate | 0.6 g |
| Pentasodium Diethylenetriaminepenta-acetate | 4.0 g |
| Potassium Sulfite | 30.0 g |
| Potassium Thiocyanate | 1.2 g |
| Potassium Carbonate | 35.0 g |
| Potassium Hydroquinone-monosulfonate | 25.0 g |
| Diethylene Glycol | 15.0 ml |
| 1-Phenyl-4-hydroxymehtyl-4-methyl-3-pyrazolidone | 2.0 g |
| Potassium Bromide | 5.0 mg |
| Water to make | 1000 ml |
| pH | 9.7 |
| Color Developer: | |
| Triethanolamine | 8.0 g |
| N,N-diethylhydroxylamine | 4.0 g |
| 3,6-Dithia-1,8-octanediol | 0.2 g |
| Disodium Ethylenediaminetetraacetate Dihydrate | 2.0 g |
| Sodium Sulfite | 0.2 g |
| Potassium Carbonate | 25.0 g |
| N-ethyl-(β-methanesulfonamidoethyl)-3-methyl-4-aminoaniline Sulfate | 8 g |
| Potassium Bromide | 0.5 g |
| Potassium Iodide | 1.0 mg |
| Water to make | 1000 ml |
| pH | 10.4 |
| Bleach-fixing Solution: | |
| 2-Mercapto-1,3,4-triazole | 0.5 g |
| Disodium Ethylenediaminetetraacetate Dihydrate | 5.0 g |
| Ammonium Ethylenediaminetetra-acetato/Fe(III) Monohydrate | 80.0 g |
| Sodium Sulfite | 15.0 g |
| Sodium Thiosulfate Solution (700 g/liter) | 160.0 ml |
| Glacial Acetic Acid | 6.0 ml |
| Water to make | 1000 ml |
| pH | 6.0 |

From the results, it was understood that the photographic material samples of this Example having the constitution of the present invention had a high sensitivity, as did those obtained in Example 1. All the samples were stored for 3 days and then exposed and processed. The samples of the present invention were verified to have a small variation of maximum density between the fresh samples and the stored samples.

While the invention has been described in detail and with reference to specific embodiments thereof, it will be apparent to one skilled in the art that various changes and modifications can be made therein without departing from the spirit and scope thereof.

What is claimed is:

1. A silver halide photographic material, comprising a support having thereon (i) a silver halide emulsion layer which contains negative-working internal latent image-forming silver halide grains which have been chemically sensitized to a depth of from 0.002 to less than 0.02 micrometer from the surface of the grain, and (ii) palladium in an amount from $1\times10^{-9}$ to $1\times10^{-2}$ mol per mol of coated silver halide.

2. The silver halide photographic material of claim 1, wherein the palladium is present in an amount from $5\times10^{-7}$ to $1\times10^{-3}$ mol per mol of coated silver halide.

3. The silver halide photographic material of claim 1, wherein the palladium is present in an amount from $1\times10^{-6}$ to $1\times10^{-4}$ mol per mol of coated silver halide.

4. The silver halide photographic material of claim 1, wherein the palladium is located in one or more silver halide emulsion layers.

5. The silver halide photographic material of claim 1, wherein the palladium is located in the silver halide emulsion layer which contains the negative-working internal latent image-forming silver halide grains which have been chemically sensitized.

6. The silver halide photographic material of claim 1, wherein the negative-working internal latent image-forming silver halide grains have been chemically sensitized to a depth of from 0.002 micrometer to less than 0.015 micrometer.

7. The silver halide photographic material of claim 1, wherein the negative-working internal latent image-forming silver halide grains have been chemically sensitized to a depth of from 0.004 micrometer to less than 0.01 micrometer.

8. The silver halide photographic material of claim 1, wherein the grain has a latent image distribution which has at least one maximum value at a point at a depth of less than 0.01 micrometer from the surface of the grain, and wherein the surface of the grain is also chemically sensitized to a degree from 1/5 to 1/1 time of the maximum value thereof.

9. The silver halide photographic material of claim 1, wherein the palladium has been added to the material during the formation of the emulsion grains.

* * * * *